US007367851B2

(12) United States Patent
Machado et al.

(10) Patent No.: US 7,367,851 B2
(45) **Date of Patent: *May 6, 2008**

(54) UNIVERSAL CONNECTOR ASSEMBLY AND METHOD OF MANUFACTURING

(75) Inventors: Russell Lee Machado, San Diego, CA (US); Victor H. Renteria, Poway, CA (US); Thuyen Dinh, San Diego, CA (US)

(73) Assignee: Pulse Engineering, Inc, San Diego, CA (US)

( * ) Notice: Subject to any disclaimer, the term of this patent is extended or adjusted under 35 U.S.C. 154(b) by 9 days.

This patent is subject to a terminal disclaimer.

(21) Appl. No.: 11/827,074

(22) Filed: Jul. 9, 2007

(65) Prior Publication Data

US 2007/0259573 A1 Nov. 8, 2007

Related U.S. Application Data

(63) Continuation of application No. 11/170,583, filed on Jun. 28, 2005, now Pat. No. 7,241,181.

(60) Provisional application No. 60/583,989, filed on Jun. 29, 2004.

(51) Int. Cl.
*H01R 24/00* (2006.01)

(52) U.S. Cl. ..... 439/676; 439/620.06; 439/620.15; 439/540.5

(58) Field of Classification Search ..... 439/676, 439/620.06, 620.07, 620.15, 620.16, 620.17, 439/541.5

See application file for complete search history.

(56) References Cited

U.S. PATENT DOCUMENTS 5,015,981 A 5/1991 Lint et al.
5,069,641 A 12/1991 Sakamoto et al.
5,531,612 A 7/1996 Goodall et al.
5,587,884 A 12/1996 Raman
5,647,767 A 7/1997 Scheer et al.
5,736,910 A 4/1998 Townsend et al.
5,759,067 A 6/1998 Scheer
5,971,805 A 10/1999 Belopolsky et al.
5,986,894 A 11/1999 Lint et al.
6,005,463 A 12/1999 Lint et al.
6,062,908 A 5/2000 Jones
6,116,963 A 9/2000 Shutter
6,132,260 A * 10/2000 Wu ..... 439/676
6,159,050 A 12/2000 Belopolsky et al.
6,171,152 B1 1/2001 Kunz
6,176,741 B1 1/2001 Shutter (Continued)

*Primary Examiner*—Tho D. Ta
(74) *Attorney, Agent, or Firm*—Gazdzinski & Associates

(57) ABSTRACT

An advanced modular plug connector assembly incorporating an insert assembly disposed in the rear portion of the connector housing. In one embodiment, the connector has a plurality of ports in multi-row configuration, and the insert assembly includes a substrate adapted to receive one or more electronic components such as choke coils, transformers, or other signal conditioning elements or magnetics. The substrate also interfaces with the conductors of two modular ports of the connector, and is removable from the housing such that an insert assembly of a different electronics or terminal configuration can be substituted therefor. In this fashion, the connector can be configured to a plurality of different standards (e.g., Gigabit Ethernet and 10/100). In yet another embodiment, the connector assembly comprises a plurality of light sources (e.g., LEDs) received within the housing. Methods for manufacturing the aforementioned embodiments are also disclosed.

34 Claims, 27 Drawing Sheets

U.S. PATENT DOCUMENTS 6,193,560 B1 2/2001 Morana et al.
6,224,425 B1 5/2001 Shutter
6,325,664 B1 12/2001 Someda et al.
6,395,983 B1 5/2002 Gutierrez
6,409,548 B1 6/2002 Gutierrez
6,471,551 B2 10/2002 Morana et al.
6,537,110 B1 3/2003 Korsunsky et al.
6,585,540 B2 7/2003 Gutierrez et al.
6,593,840 B2 7/2003 Morrison et al.
6,642,827 B1 11/2003 McWilliams et al.
6,761,595 B1 7/2004 Zheng et al.
6,769,936 B2 8/2004 Gutierrez et al.
6,773,298 B2 8/2004 Gutierrez et al.
6,773,302 B2 8/2004 Gutierrez et al.
6,786,772 B1 * 9/2004 Liu ..... 439/620.06
6,848,943 B2 2/2005 Machado et al.
6,962,511 B2 11/2005 Gutierrez et al.
7,241,181 B2 * 7/2007 Machado et al. ..... 439/676
2003/0022553 A1 1/2003 Chen et al.

* cited by examiner (PART 1 OF 3)

(PART 2 OF 3)

(PART 3 OF 3)

UNIVERSAL CONNECTOR ASSEMBLY AND METHOD OF MANUFACTURING

PRIORITY

This application is a continuation of co-owned U.S. patent application Ser. No. 11/170,583 of the same title filed Jun. 28, 2005, U.S. Pat. No. 7,241,181, which claims priority to U.S. Provisional Patent Application Ser. No. 60/583,989 filed Jun. 29, 2004 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to electronic components, and particularly to an improved design for, and method of manufacturing a single- or multi-connector assembly which may include internal electronic components.

DESCRIPTION OF RELATED TECHNOLOGY

Modular connectors, such as for example those of the "RJ" configuration, are well known in the electronics industry. Such connectors are adapted to receive one or more modular plugs of varying type (e.g., RJ-45 or RJ-11), and communicate signals between the terminals of the modular plug and the parent device with which the connector is associated. Commonly, some form of signal conditioning (e.g., filtering, voltage transformation, or the like) is performed by the connector on the signals passing through it.

Many different considerations are involved with producing an effective and economically viable connector design. Such considerations include, for example: (i) volume and "footprint" available for the connector; (ii) the need for electrical status indicators (e.g., LEDs); (iii) the cost and complexity associated with assembling and manufacturing the device; (iv) the ability to accommodate various electrical components and signal conditioning configurations; (v) the electrical and noise performance of the device; (vi) the reliability of the device; (vii) the ability to modify the design to accommodate complementary technologies; (viii) compatibility with existing terminal and "pin out" standards and applications; (ix) ability to configure the connector as one of a plurality of ports, potentially having individually variant internal component configurations, and (ix) potentially the maintenance or replacement of defective components.

Electrical connectors (including modular jacks) are increasingly used in data networking applications, such as wired or wireless LANs, whether for computers or other electronic devices (such as routers, gateways, hubs, switching centers, digital set-top boxes, etc.). Increasing requirements for data connectivity and capability are driving greater adoption of these connectors across a broader spectrum of applications. Increased data rate requirements, such as those mandated under so-called "gigabit Ethernet" (GBE) standards, are also increasing the performance demands on these connectors. As more capability and components (such as both discrete and integrated circuitry) are disposed within the connector, more efficient use of the available volume within the connector, and more efficient heat dissipation, are also required.

The foregoing factors have resulted in myriad different (and often highly specialized) configurations for modular connectors in the prior art. Many of these designs utilize an internal PCB or substrate for carrying electronic or signal conditioning components internal to the connector housing. For example, U.S. Pat. No. 5,069,641 to Sakamoto, et al. issued Dec. 3, 1991 and entitled "Modular jack" discloses a modular jack to be mounted on a circuit board, and the modular jack has a printed board containing a noise suppressing electronic element in a housing. The printed board is fitted with contactors for contacting with plugs and terminals to be used for mounting the modular jack on the circuit board. The contactors and the terminals are electrically connected with the noise suppressing electronic element by wires on the printed board.

U.S. Pat. No. 5,531,612 to Goodall, et al. issued Jul. 2, 1996 entitled "Multi-port modular jack assembly" discloses a modular jack assembly for mounting to a printed circuit board, is shown comprising a plurality of modular jacks assembled to a common integral housing and disposed in back-to-back mirror image symmetry. Shielding, is provided around the connector assembly and shielding between the two rows is also provided for suppressing cross-talk there between. The design is compact, providing for a large number of ports without increasing the length of the connector assembly, whilst also providing good access to the resilient locking latches of complementary modular plugs received by the jacks.

U.S. Pat. No. 5,587,884 to Raman issued Dec. 24, 1996 and entitled "Electrical connector jack with encapsulated signal conditioning components" discloses a modular jack electrical connector assembly suitable for conditioning the signals in unshielded twisted pair wires for use with network components is disclosed. The modular jack comprises a conventional insulative housing and an insert subassembly including insert molded front insert member and rear insert member. Contact terminals for mating with a modular plug extend from the front insert member and into the rear insert member. The rear insert member also includes signal conditioning components such as common mode choke coils, filter circuits and transformers suitable for conditioning the twisted pair signals for used in applications such as for input to and output from IEEE 10 Base-T network components.

U.S. Pat. No. 5,647,767 to Scheer, et al. issued Jul. 15, 1997 and entitled "Electrical connector jack assembly for signal transmission" discloses a modular jack electrical connector assembly for conditioning the signals in unshielded twisted pair wires for use with network components. The modular jack comprises a conventional insulative housing and an insert subassembly including an insert molded front insert member and a rear insert member. Contact terminals for mating with a modular plug extend from the front insert member and into the rear insert member. The rear insert member also includes signal conditioning components such as common mode choke coils, filter circuits and transformers suitable for conditioning the twisted pair signals for used in applications such as for input to and output from IEEE 10 Base-T network components. The rear insert member includes an insert molded body which stabilizes the position of the contact terminals and leads extending from the rear insert member for attachment to external circuits, such as the external printed circuit board containing the interface processor for the specific application.

U.S. Pat. No. 5,759,067 entitled "Shielded Connector" to Scheer exemplifies a common prior art approach. In this configuration, one or more PCBs are disposed within the connector housing in a vertical planar orientation such that an inner face of the PCB is directed toward an interior of the assembly and an outer face directed toward an exterior of the assembly.

U.S. Pat. No. 6,171,152 to Kunz issued Jan. 9, 2001 entitled "Standard footprint and form factor RJ-45 connector with integrated signal conditioning for high speed networks" discloses an RJ-45 style modular connector having a plastic rectangular housing with an open front end to receive a matching RJ-45 style modular jack, and an opposite open back end. A contact spring assembly of a plurality of wires in separate circuits passes forward through said open back end into the back of said open front end of the housing. The contact assembly also includes a plastic block that supports the plurality of wires by a right angle turn and is vertically oriented with respect to the plurality of wires, and the plastic block inserts and locks into the open back end of the housing. A set of mounting pins is disposed at a bottom edge of the plastic block for connection to a printed motherboard. A signal conditioning part is disposed in the plastic block for providing signal conditioning of signals passing from said set of mounting pins to the contact spring assembly.

U.S. Pat. No. 6,585,540 to Gutierrez, et al. issued Jul. 1, 2003 and entitled "Shielded microelectronic connector assembly and method of manufacturing" discloses a multi-connector electronic assembly incorporating different noise shield elements which reduce noise interference and increase performance. In one embodiment, the connector assembly comprises a plurality of connectors with associated electronic components arranged in two parallel rows, one disposed atop the other. The assembly utilizes a substrate shield which mitigates noise transmission through the bottom surface of the assembly, as well as an external "wrap-around shield to mitigate noise transmission through the remaining external surfaces. In a second embodiment, the connector assembly further includes a top-to-bottom shield interposed between the top and bottom rows of connectors to reduce noise transmission between the rows of connectors, and a plurality of front-to-back shield elements disposed between the electronic components of respective top and bottom row connectors to limit transmission between the electronic components.

U.S. Pat. No. 6,769,936 to Gutierrez, et al. issued Aug. 3, 2004 entitled "Connector with insert assembly and method of manufacturing" discloses a modular plug connector assembly incorporating a substantially planar, low profile removable insert assembly with associated substrate disposed in the rear portion of the connector housing, the substrate adapted to optionally receive one or more electronic components. In one embodiment, the connector assembly comprises a single port with a single insert assembly. The conductors and terminals of the connector are retained within respective molded carriers which are received within the insert assembly. A plurality of light sources (e.g., LEDs) are also received within the housing, the conductors of the LEDs mated with conductive traces on the substrate of the insert assembly. In another embodiment, the connector assembly comprises a multi-port "1×N" device.

U.S. Pat. No. 6,773,302 to Gutierrez, et al. issued Aug. 10, 2004 entitled "Advanced microelectronic connector assembly and method of manufacturing" discloses a modular plug connector assembly incorporating a substrate disposed in the rear portion of the connector housing, the substrate adapted to receive one or more electronic components such as choke coils, transformers, or other signal conditioning elements or magnetics. In one embodiment, the connector assembly comprises a single port pair with a single substrate disposed in the rear portion of the housing. In another embodiment, the assembly comprises a multi-port "row-and-column" housing with multiple substrates (one per port) received within the rear of the housing, each substrate having signal conditioning electronics which condition the input signal received from the corresponding modular plug before egress from the connector assembly. In yet another embodiment, the connector assembly comprises a plurality of light sources (e.g., LEDs) received within the housing.

U.S. Pat. No. 6,848,943 to Machado, et al. issued Feb. 1, 2005 entitled "Shielded connector assembly and method of manufacturing" discloses a shielded modular plug connector assembly incorporating a removable insert assembly disposed in the connector housing, the insert assembly adapted to optionally receive one or more electronic components. In one exemplary embodiment, the connector assembly comprises a single port connector with integral shielded housing and dual-substrate insert assembly. The housing is advantageously formed using a metal casting process which inherently shields the connector (and exterior environment) from EMI and other noise while allowing for a reduced housing profile.

The foregoing citations are merely exemplary of a much larger number of substantially different approaches to filtered (and unfiltered) modular jacks, such as those used in Ethernet (10/100) or GBE LAN or other data networking applications. However, the foregoing prior art configurations are not optimized in terms of application flexibility, as well as their other required attributes. Specifically, each of the foregoing solutions is limited to one particular configuration selected at the time of manufacture. This generally necessitates manufacturing, distributing, and selling multiple different variants of the same basic connector design, each such variant having the particular attributes desired for a given application. For example, a traditional 10/100 Ethernet jack utilizes a given set of magnetics (filtration) and other electrical circuitry, as well as a particular pin-out and footprint for mating to a motherboard or other device. Similarly, a connector for use in a GBE application may have a different magnetics configuration and different pin-out/footprint. Hence, two distinct products would be required to fill these two needs. This situation is less than optimal, since it requires at least some separation of manufacturing process, distribution, stocking, and sale (e.g., different manufacturing lines, labeling, cataloging, part numbers, etc.).

Accordingly, it would be most desirable to provide an improved electrical connector (e.g., modular jack) design that would provide reliable and superior electrical and noise performance, while also providing application flexibility. Such a connector design would ideally allow for the ready use of a variety of different electronic signal conditioning components in the connector signal path(s), as well as status indicators if desired, without affecting connector profile or overall footprint, or requiring changes to the housing. The improved connector design would also facilitate easy assembly, as well as removal of the internal components of the device if required. The design would further be amenable to integration into a multi-port connector assembly, including the ability to vary the configuration of the internal components associated with individual port pairs of the assembly.

SUMMARY OF THE INVENTION

The present invention satisfies the foregoing needs by providing an improved electrical connector assembly which is substantially flexible in its application and configuration.

In a first aspect of the invention, an improved connector assembly for use on, inter alia, a printed circuit board or other device is disclosed. In one exemplary embodiment, the assembly comprises a connector housing having a single port pair (i.e., two modular plug recesses), a plurality of conductors disposed within the recesses for contact with the terminals of the modular plug, and at least one component substrate disposed in the rear portion of the housing, the component substrate (and its traces) forming part the electrical pathway between the conductors and the corresponding circuit board leads. The substrate mates with terminals of an insert assembly, the latter optionally having a plurality of signal conditioning components disposed in the signal path between the aforementioned conductors and those mating with the parent device (e.g., motherboard or PCB). The insert assembly can be adapted to any number of lead (and electronics) configurations and applications. For example, in one variant, the insert assembly is adapted for use in Gigabit Ethernet (GBE) applications, while in another it is adapted for Ethernet 10/100 applications.

In a second exemplary embodiment, the assembly comprises a connector housing having a plurality of connector recesses arranged in port pairs, the recesses arranged in substantially over-under and side-by-side orientation.

In a second aspect of the invention, the connector assembly further includes a plurality of light sources (e.g., LEDs) adapted for direct or indirect viewing by an operator during operation. The light sources advantageously permit the operator to determine the status of each of the individual connectors simply by viewing the front of the assembly. In one exemplary embodiment, the connector assembly comprises a single port pair having LEDs disposed relative to the recesses and adjacent to the modular plug latch formed therein, such that the LEDs are readily viewable from the front of the connector assembly. The LED conductors (two per LED) are mated with the upper substrates within the rear of the housing. In another embodiment, the LED conductors comprise continuous electrodes which terminate directly to the printed circuit board/external device. A multi-port embodiment having a plurality of modular plug recesses arranged in row-and-column fashion, and a pair of LEDs per recess, is also disclosed.

In another exemplary embodiment, the light sources comprise a "light pipe" arrangement wherein an optically conductive medium is used to transmit light of the desired wavelength(s) from a remote light source (e.g., LED) to the desired viewing location on the connector. In one variant, the light source comprises an LED which is disposed substantially on the PCB or device upon which the connector assembly is ultimately mounted, wherein the optically conductive medium receives light energy directly from the LED.

In a third aspect of the invention, an improved electronic assembly utilizing the aforementioned connector assembly is disclosed. In one exemplary embodiment, the electronic assembly comprises the foregoing connector assembly which is mounted to a printed circuit board (PCB) substrate having a plurality of conductive traces formed thereon, and bonded thereto using a soldering process, thereby forming a conductive pathway from the traces through the conductors of the respective connectors of the package. In another embodiment, the connector assembly is mounted on an intermediary substrate, the latter being mounted to a PCB or other component using a reduced footprint terminal array.

In a fourth aspect of the invention, an improved method of manufacturing the connector assembly of the present invention is disclosed. In one embodiment, the method generally comprises the steps of forming an assembly housing having at least two modular plug receiving recesses and at least one rear cavity disposed therein; providing a plurality of conductors comprising a first set adapted for use within the first recess of the housing element so as to mate with corresponding conductors of a modular plug; providing another plurality of conductors comprising a second set adapted for use within the second recess of the housing element so as to mate with corresponding conductors of a second modular plug; providing at least one substrate having electrical pathways formed thereon, and adapted for receipt within the rear cavity; terminating one end of the conductors of the first set to the substrate; terminating one end of the conductors of the second set to the substrate; providing a third set of conductors adapted for termination to the substrate and which form at least a portion of an electrical pathway to an external device (e.g., circuit board) to which the connector will be mated; and terminating the third set of conductors to the substrate. The termination of the third set to the substrate thereby forms an electrical pathway from the modular plugs (when inserted in the recess) through at least one of the conductors of the first and second set to the distal end of at least one of the conductors of the third set. A fourth set of conductors may optionally be used to route signals from the third set of conductors to the external device.

In another embodiment of the method, one or more electronic components are mounted on the substrate(s), thereby providing an electrical pathway from the modular plug terminals through the electronic component(s) to the distal ends of the third terminals.

BRIEF DESCRIPTION OF THE DRAWINGS

The features, objectives, and advantages of the invention will become more apparent from the detailed description set forth below when taken in conjunction with the drawings, wherein:

FIG. 1*l* is a rear perspective exploded view of a terminal insert assembly of the connector assembly of FIG. 1.

DETAILED DESCRIPTION OF THE PREFERRED EMBODIMENT

Reference is now made to the drawings wherein like numerals refer to like parts throughout.

It is noted that while the following description is cast primarily in terms of a plurality of RJ-type connectors and associated modular plugs of the type well known in the art, the present invention may be used in conjunction with any number of different connector types. Accordingly, the following discussion of the RJ connectors and plugs is merely exemplary of the broader concepts.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination. For example, the improved toroidal device disclosed in Assignee's co-pending U.S. patent application Ser. No. 09/661,628 entitled "Advanced Electronic Microminiature Coil and Method of Manufacturing" filed Sep. 13, 2000, which is incorporated herein by reference in its entirety, may be used in conjunction with the invention disclosed herein.

As used herein, the term "signal conditioning" or "conditioning" shall be understood to include, but not be limited to signal voltage transformation, filtering, current limiting, sampling, processing, and time delay.

As used herein, the term "port pair" refers to an upper and lower modular connector (port) which are in a substantially over-under arrangement; i.e., one port disposed substantially atop the other port, whether directly or offset in a given direction.

As used herein, the term "interlock base" refers generally to, without limitation, a structure such as that disclosed in U.S. Pat. No. 5,015,981 to Lint, et al. issued May 14, 1991 entitled "Electronic microminiature packaging and method", U.S. Pat. No. 5,986,894 to Lint, et al. issued Nov. 16, 1999 entitled "Microelectronic component carrier and method of its manufacture", U.S. Pat. No. 6,005,463 to Lint, et al. issued Dec. 21, 1999 entitled "Through-hole interconnect device with isolated wire-leads and component barriers", U.S. Pat. No. 6,395,983 to Gutierrez issued May 28, 2002 entitled "Electronic packaging device and method", or U.S. Pat. No. 6,593,840 to Morrison, et al. issued Jul. 15, 2003 entitled "Electronic packaging device with insertable leads and method of manufacturing", each of the foregoing incorporated herein by reference in its entirety.

Multi-Port Embodiment

Figure 1:
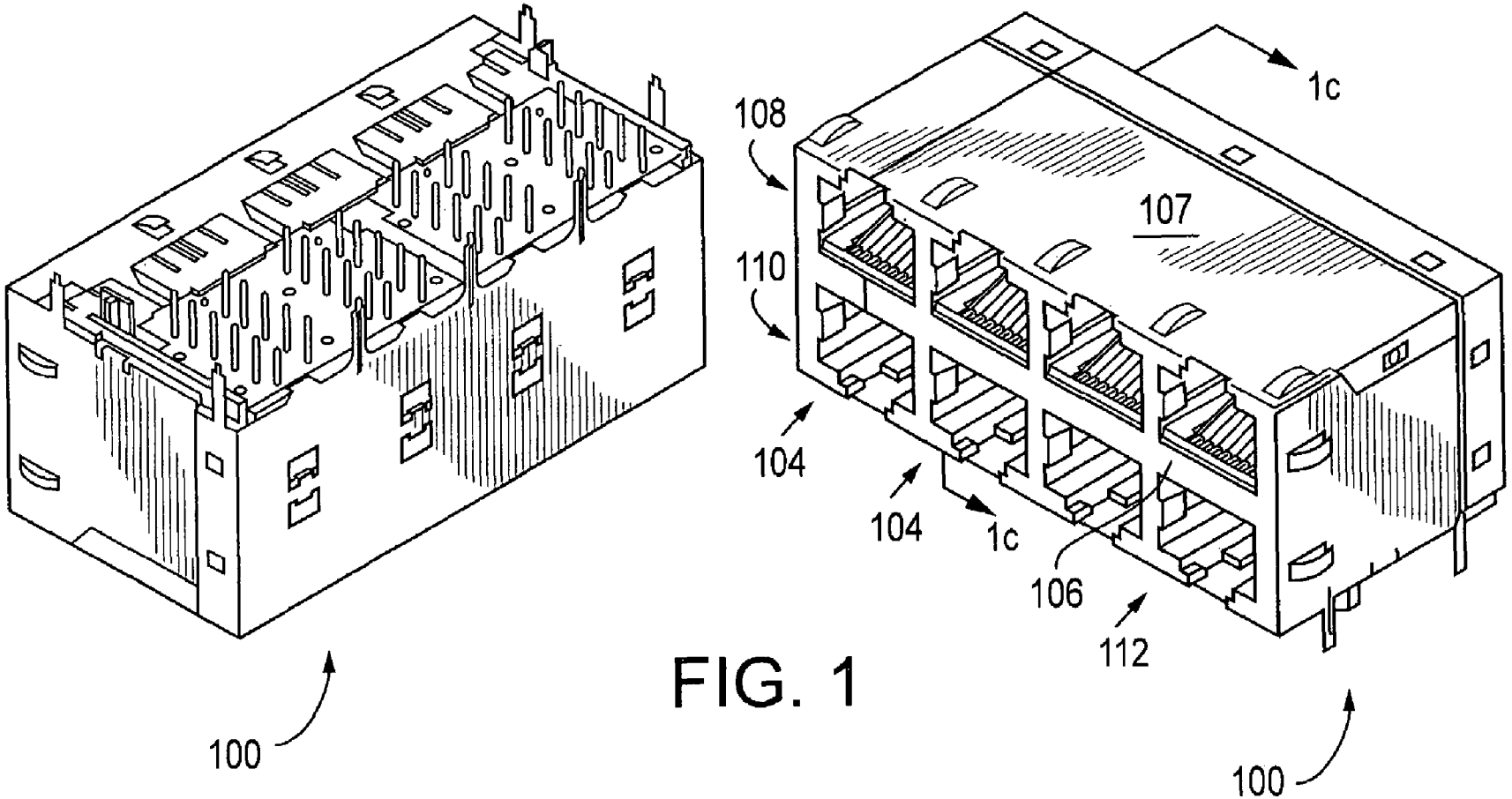
FIG. 1 shows front and back perspective views of a first exemplary embodiment (shielded 2×4, for Gigabit Ethernet or GBE) of the connector assembly according to the present invention.
Figure 1A:
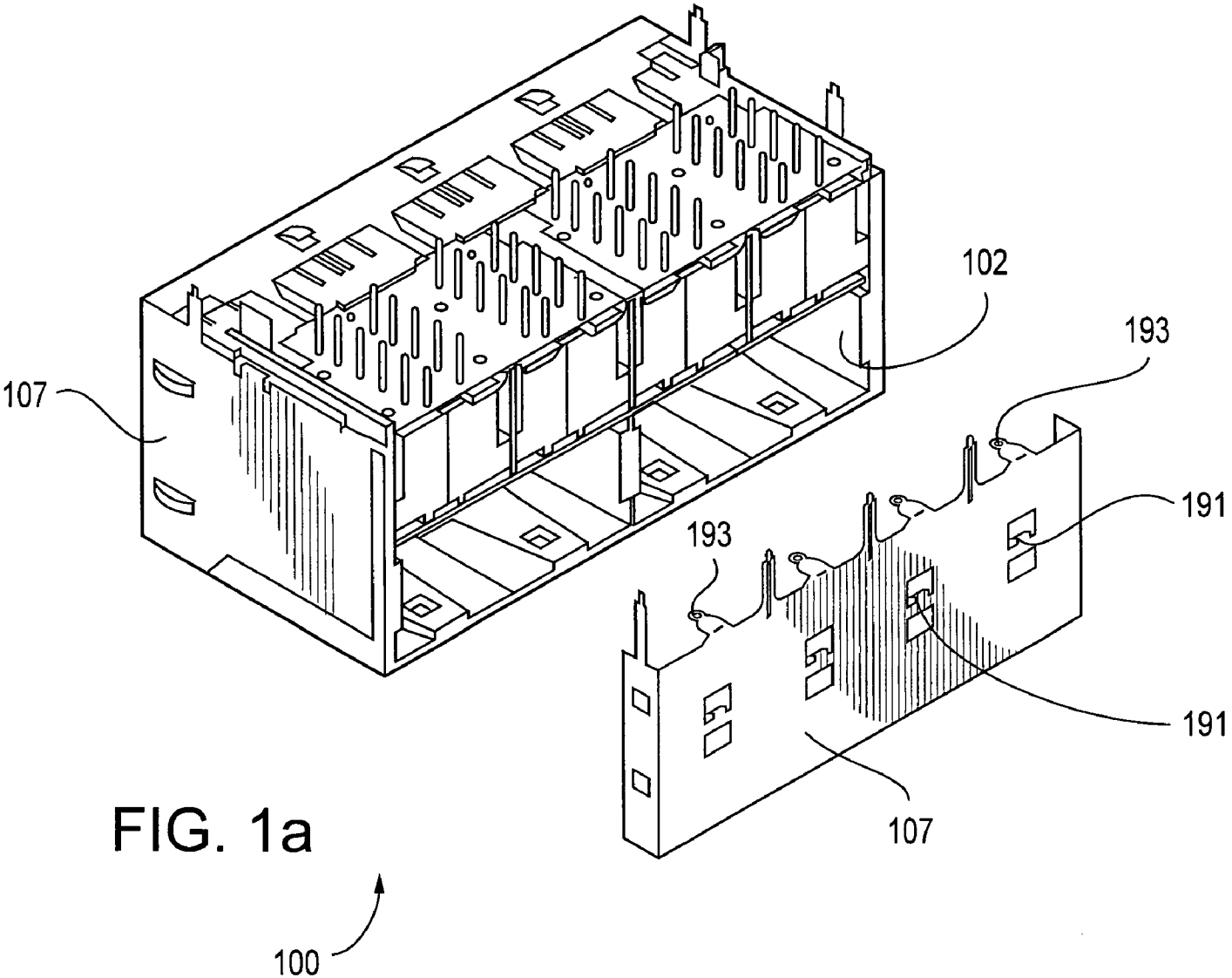
FIG. 1*a* is a rear perspective view of the connector assembly of FIG. 1, showing the rear shield removed.
Figure 1B:
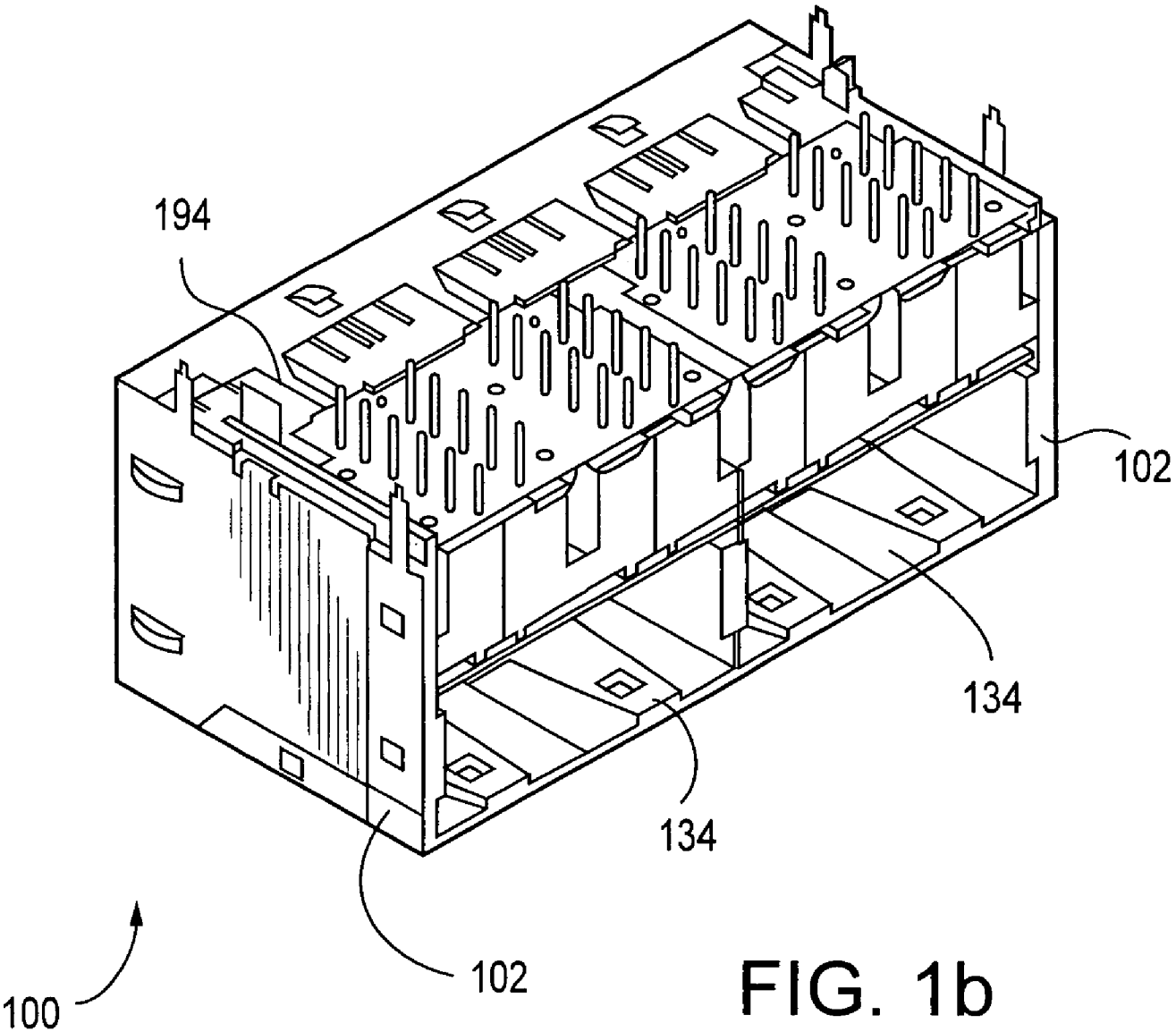
FIG. 1*b* is a rear perspective view of the connector assembly of FIG. 1, showing the relationship between the shield and the lower substrate.
Figure 1C:
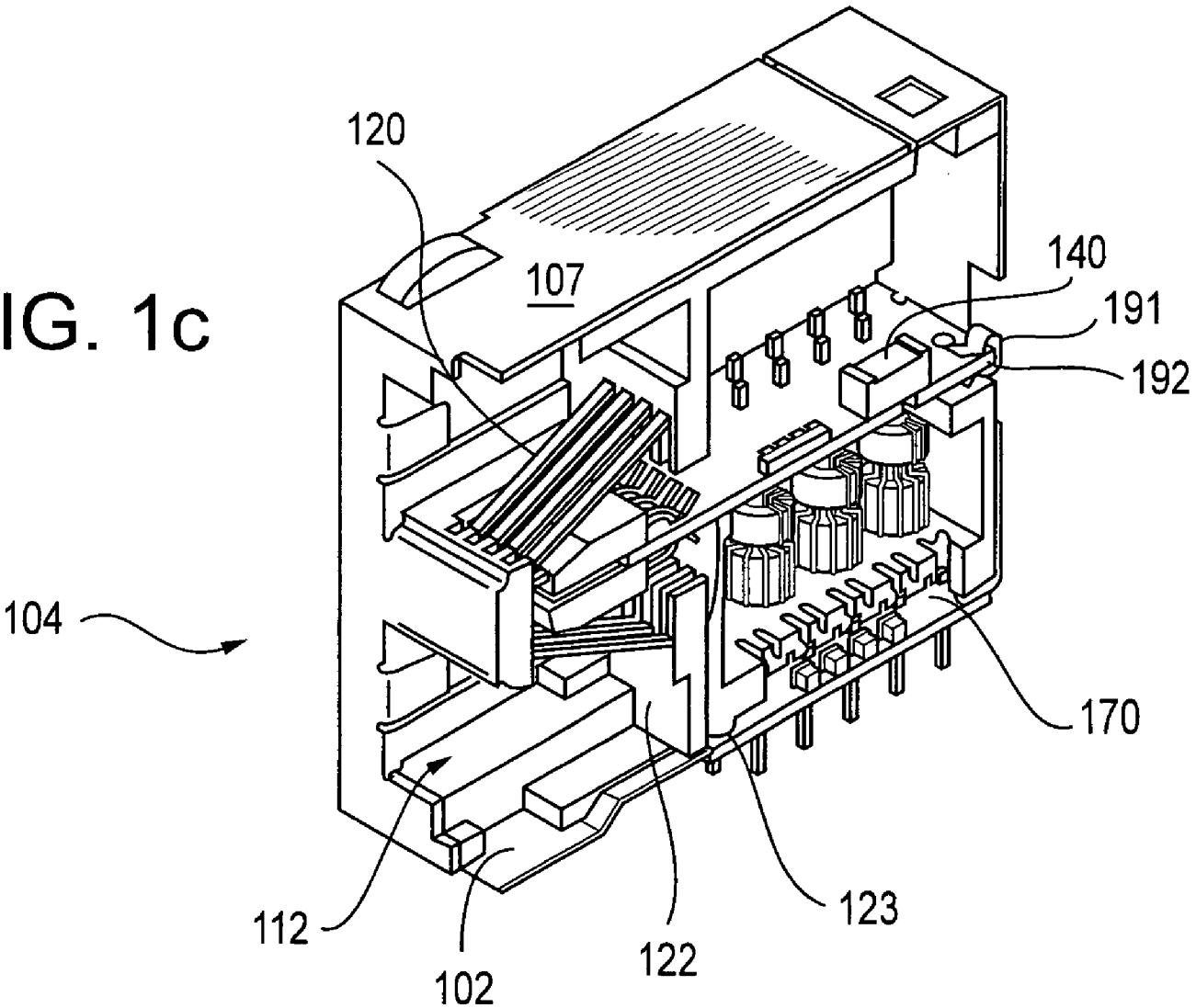
FIG. 1*c* shows side perspective cutaway views of the connector assembly according to FIG. 1, taken along line 1*c*-1*c*.
Figure 1D:
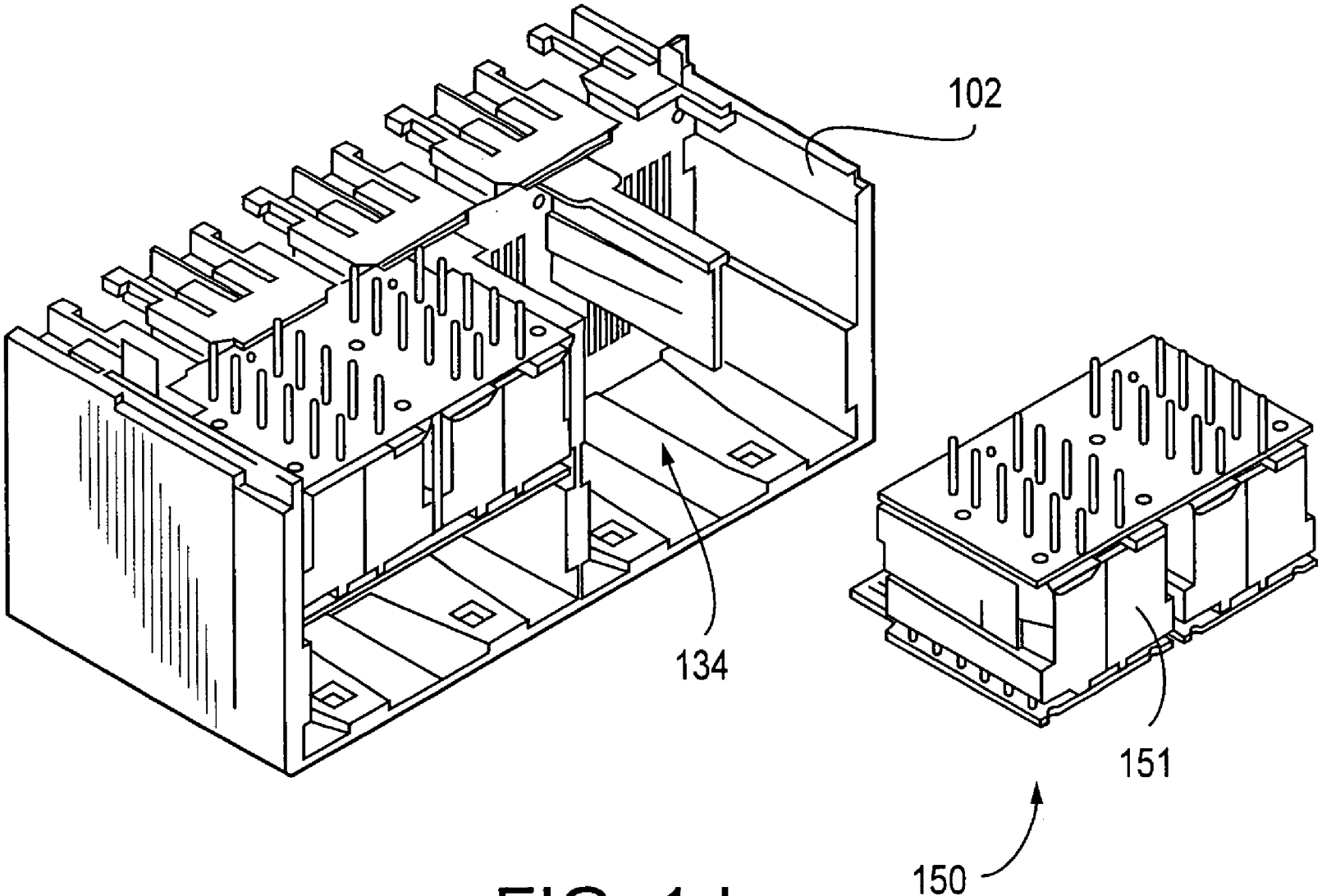
FIG. 1*d* is a rear perspective view of the connector assembly of FIG. 1, showing one insert assembly removed.
Figure 1E:
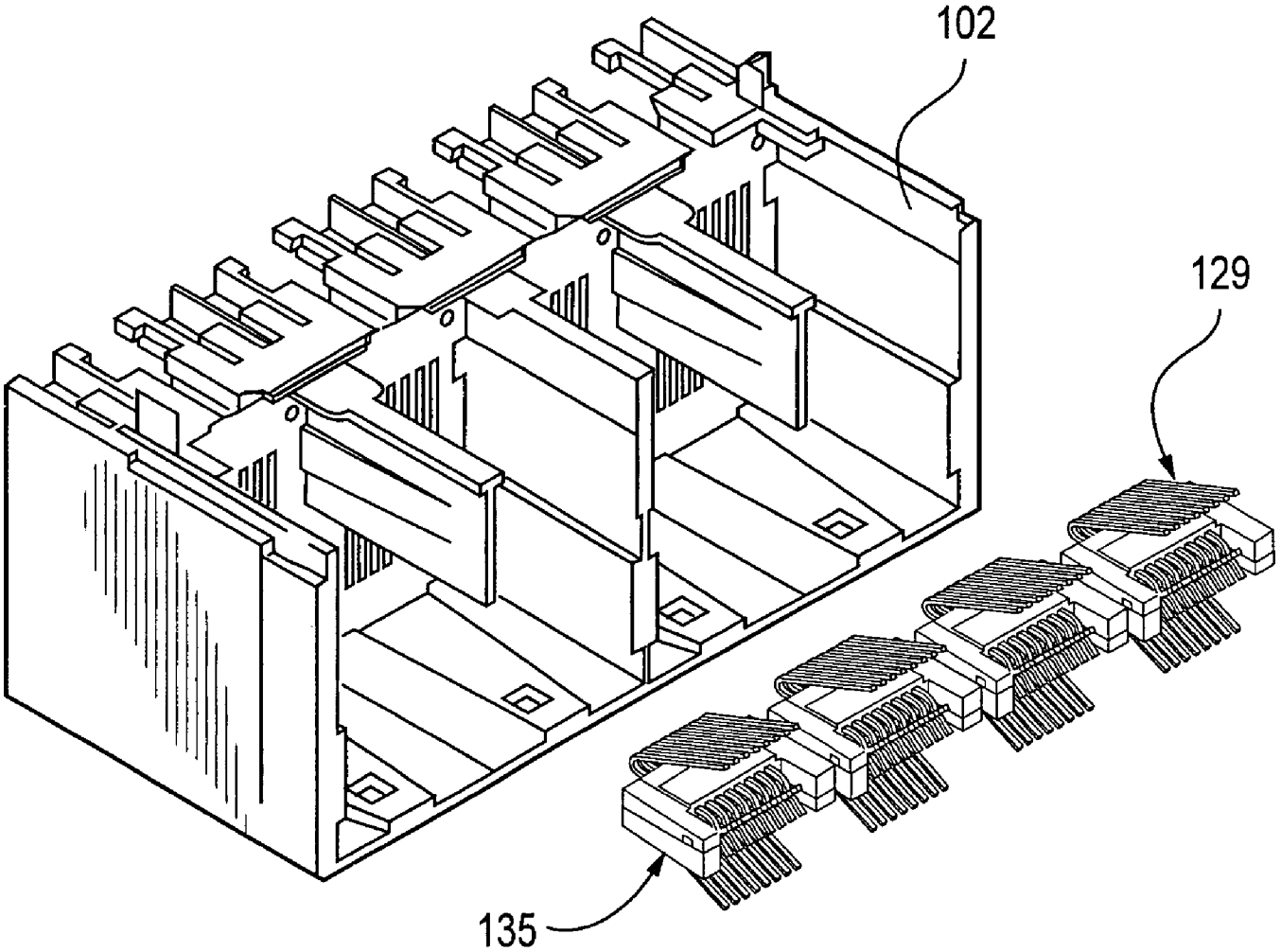
FIG. 1*e* is a rear perspective view of the housing element of the connector assembly of FIG. 1, showing the terminal insert assemblies removed and various housing element details.
Figure 1F:
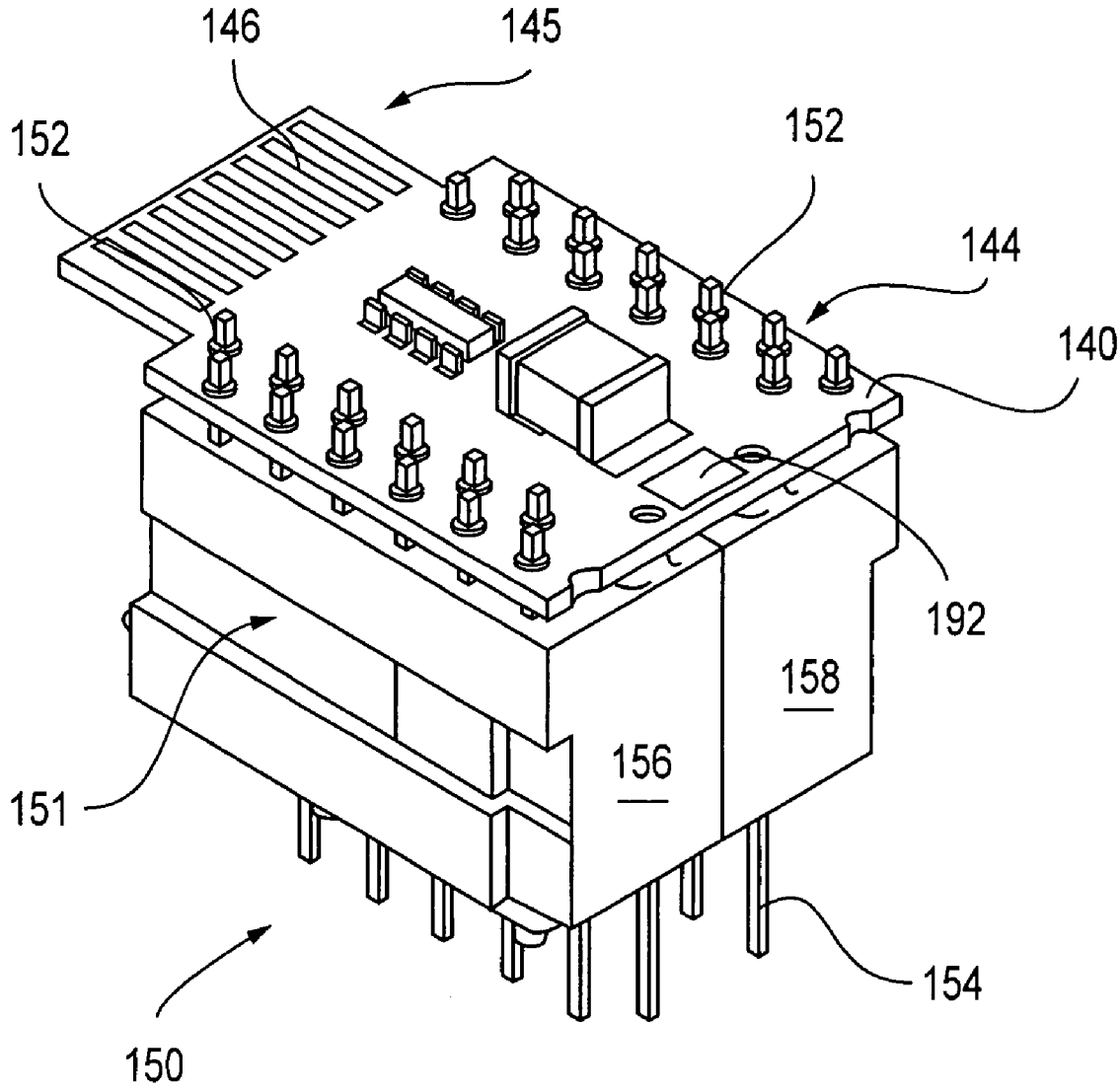
FIG. 1*f* is a rear perspective view of an insert assembly of the connector assembly of FIG. 1.
Figure 1G:
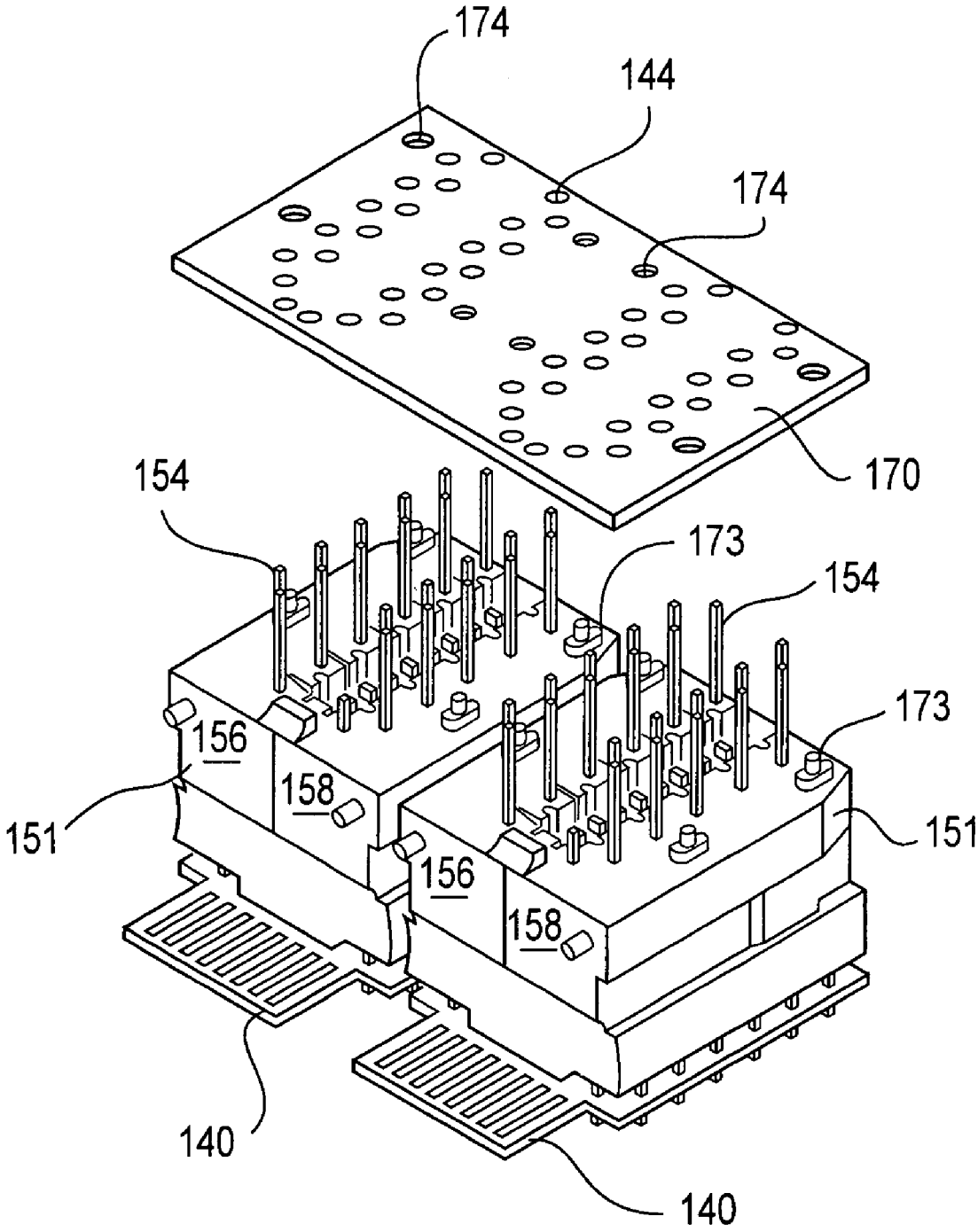
FIG. 1*g* is a front perspective view of the insert assemblies of the connector assembly of FIG. 1, with lower substrate removed.
Figure 1H:
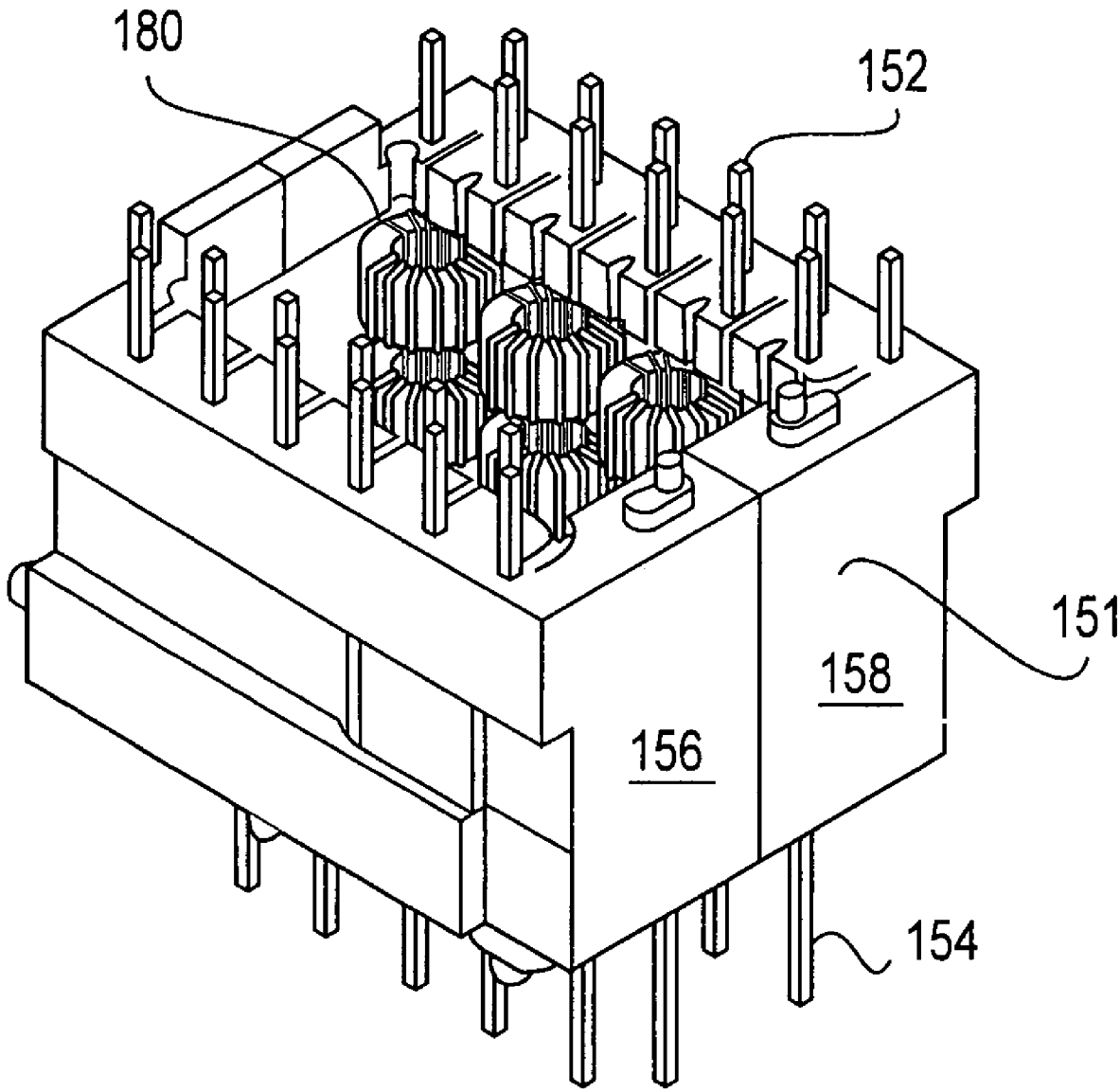
FIG. 1*h* is a rear perspective view of an insert assembly of the connector assembly of FIG. 1, with lower and upper substrates removed.
Figure 1I:
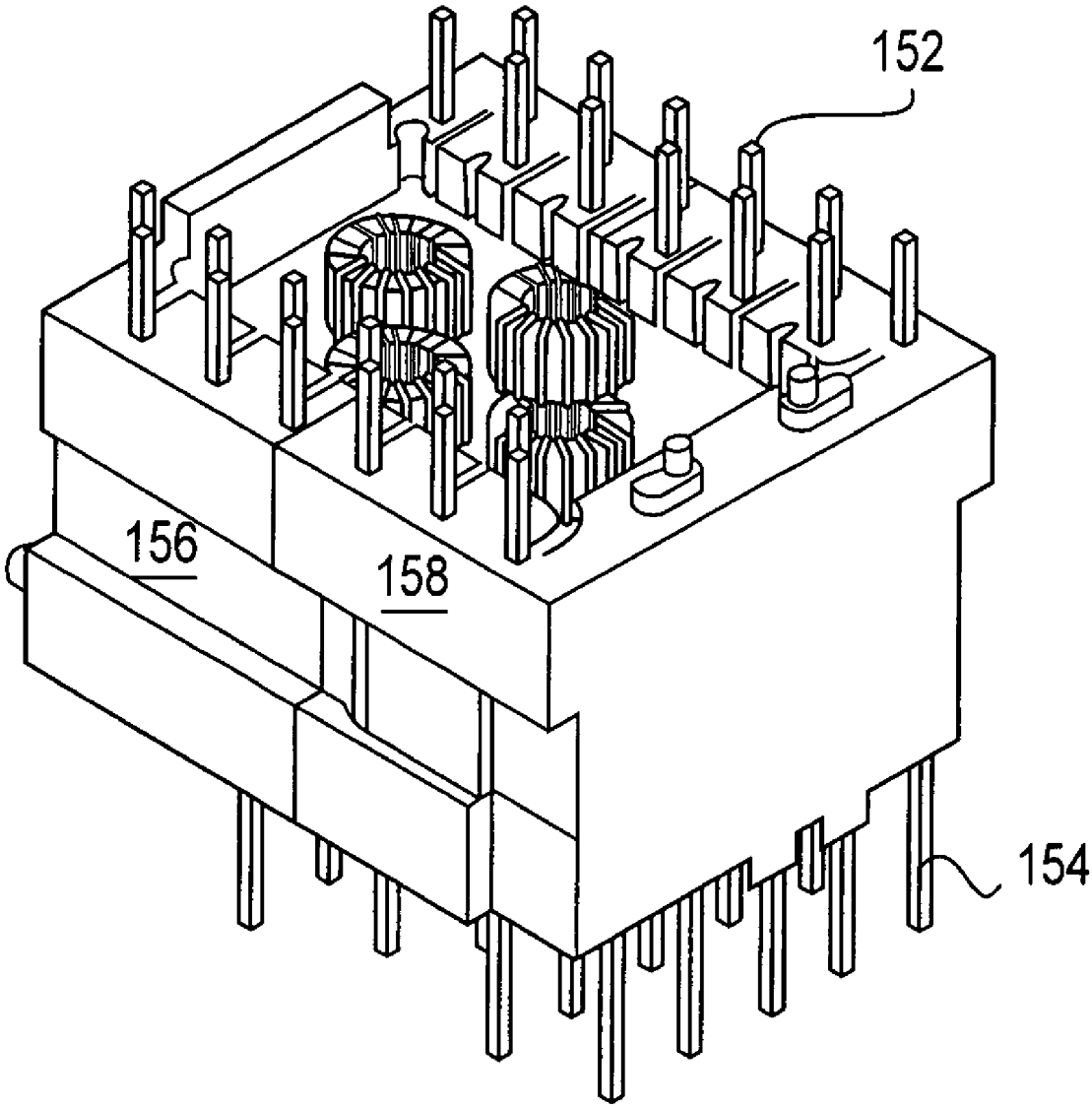
FIG. 1*i* is a rear perspective view of an alternate embodiment of the insert assembly of the connector (with lower and upper substrates removed), showing adaptation for a typical 10/100 Ethernet application.
Figure 1J:
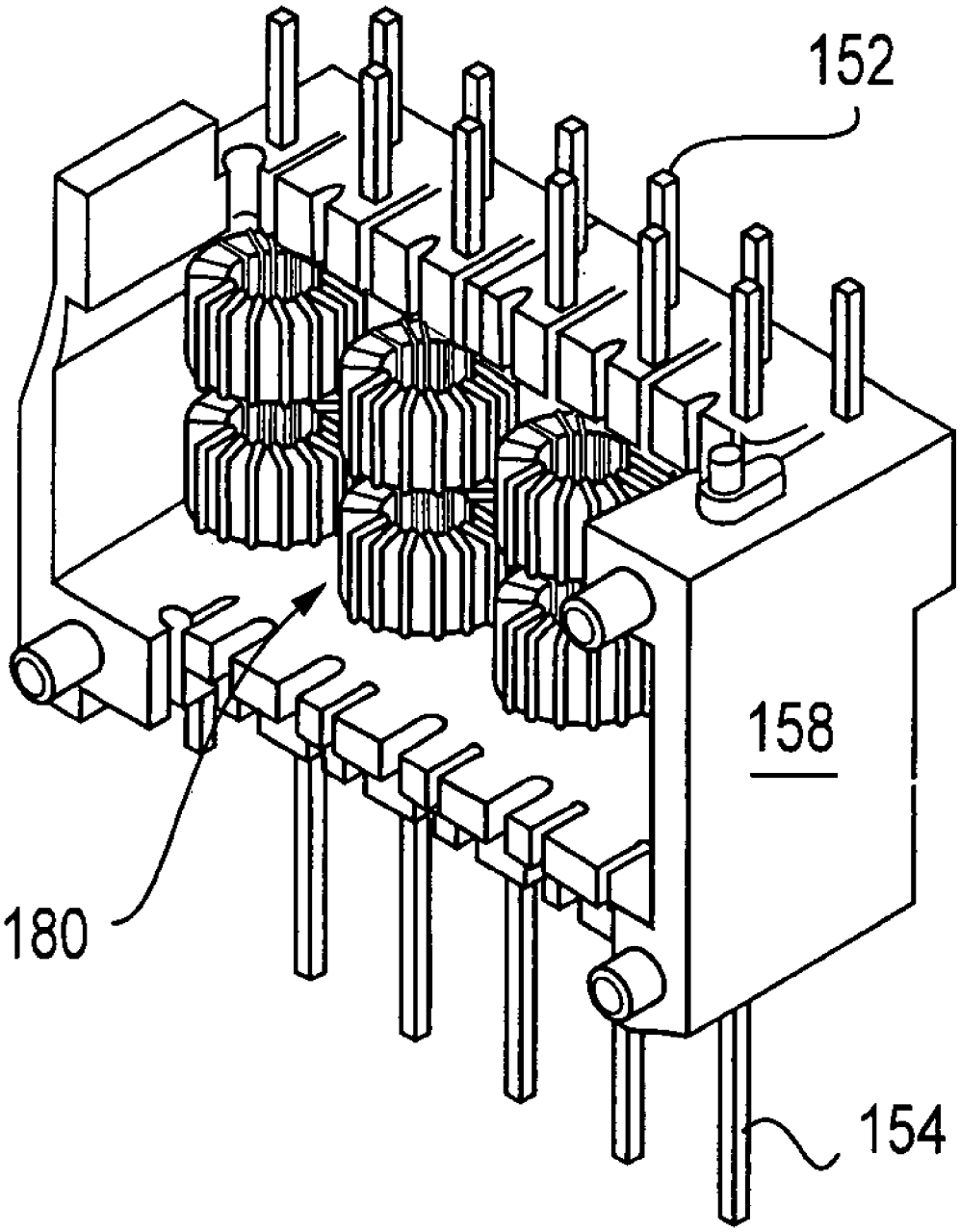
FIG. 1*j* is a rear perspective view of the insert assembly body of FIG. 1*h*, with one-half removed.
Figure 1K:
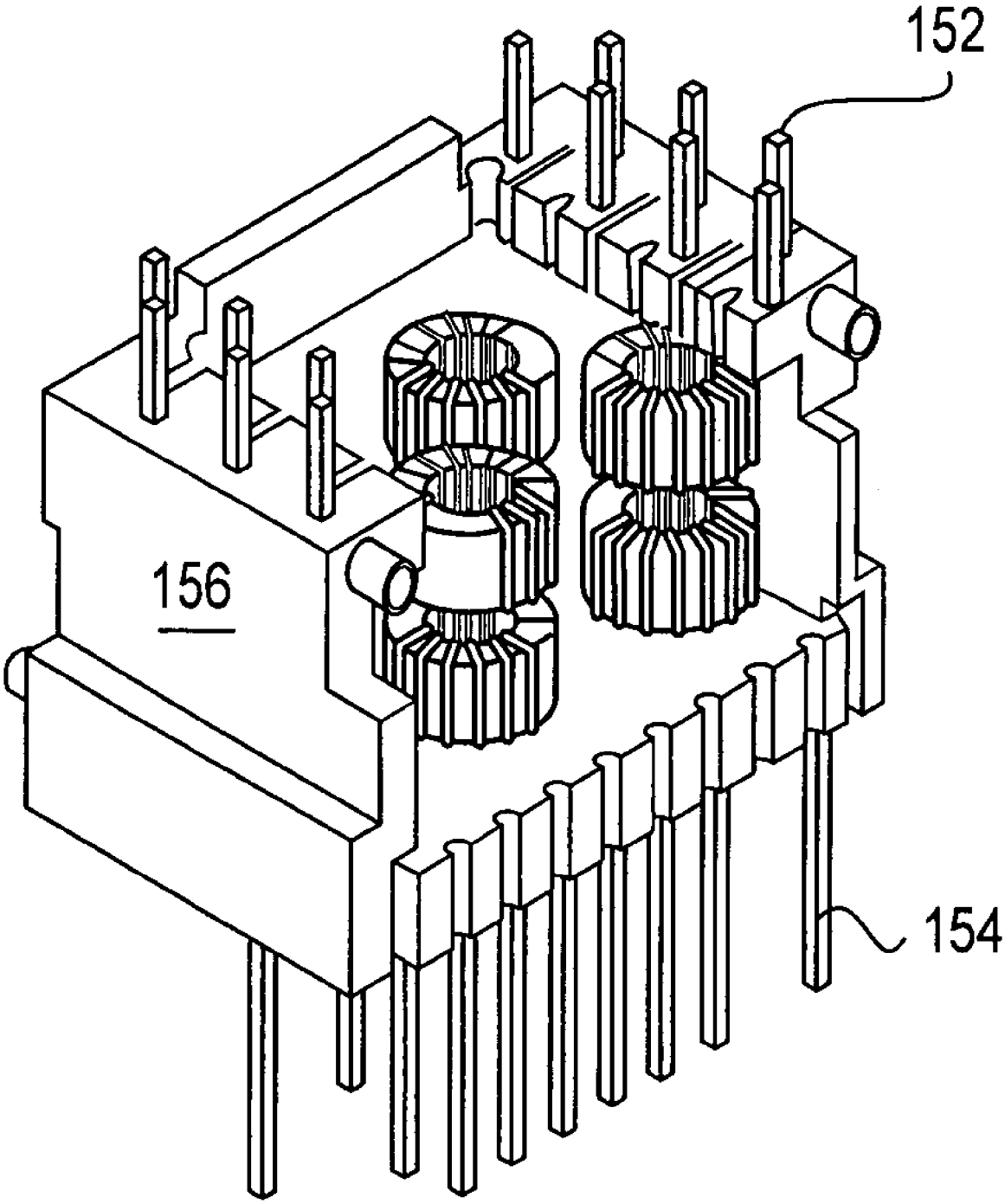
FIG. 1*k* is a rear perspective view of the insert assembly body of FIG. 1*i*, with one-half removed.
Figure 1I:
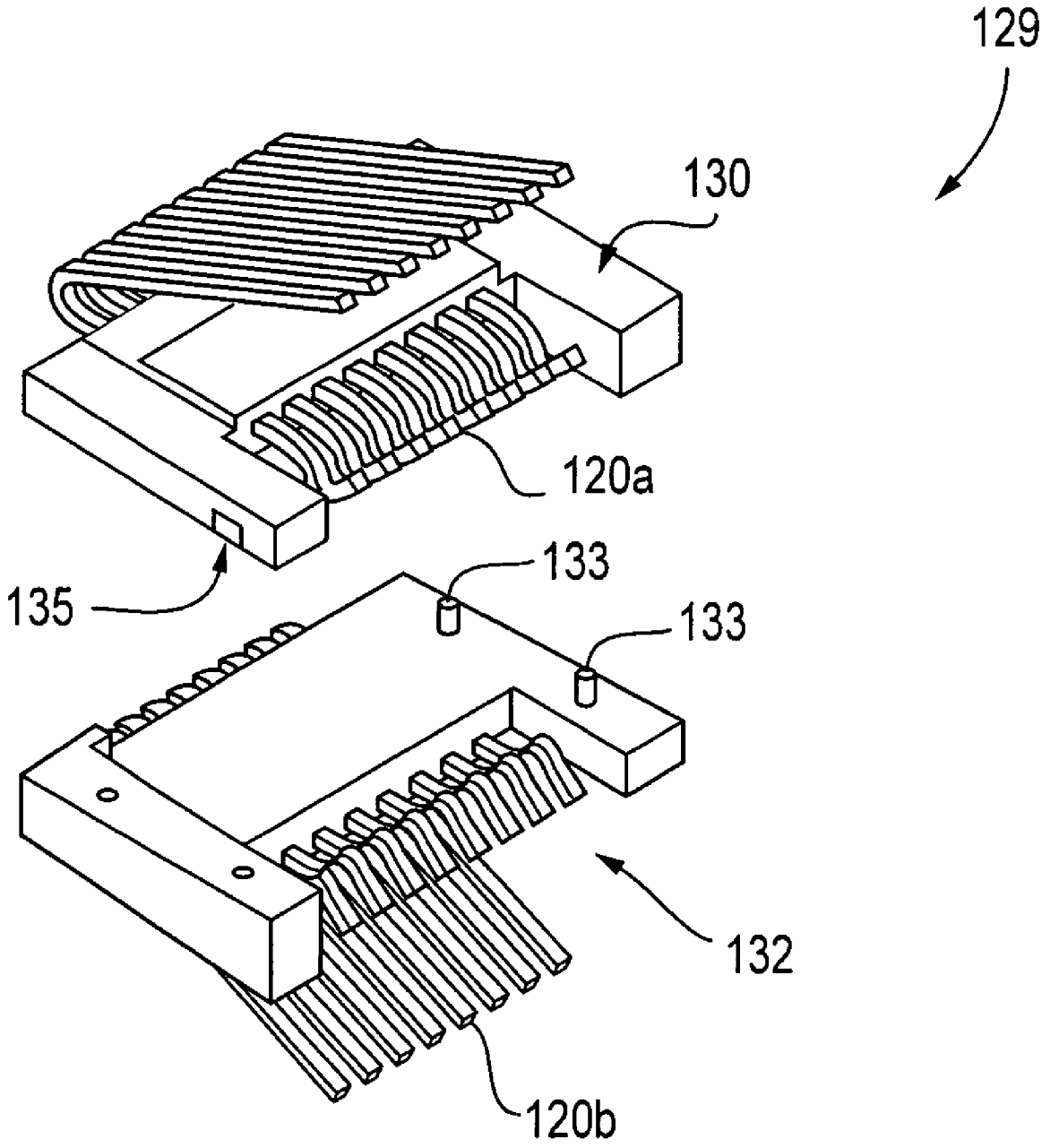
Figure 1M:
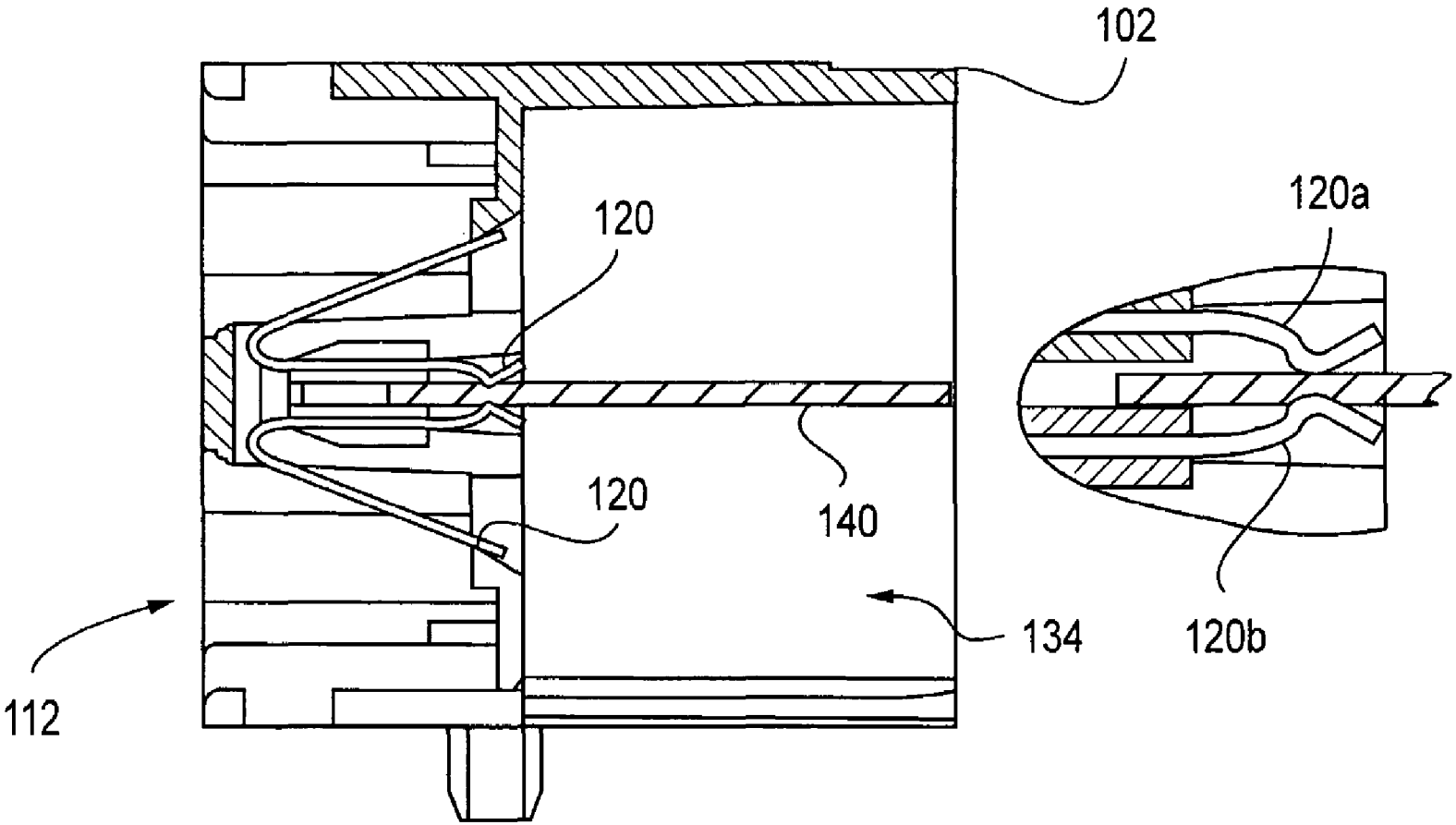
FIG. 1*m* is a cross-sectional view of the connector assembly of FIG. 1 taken along line 1*c*-1*c*, showing the interior arrangement of the terminal insert assembly and the upper substrate.
Figure 1O:
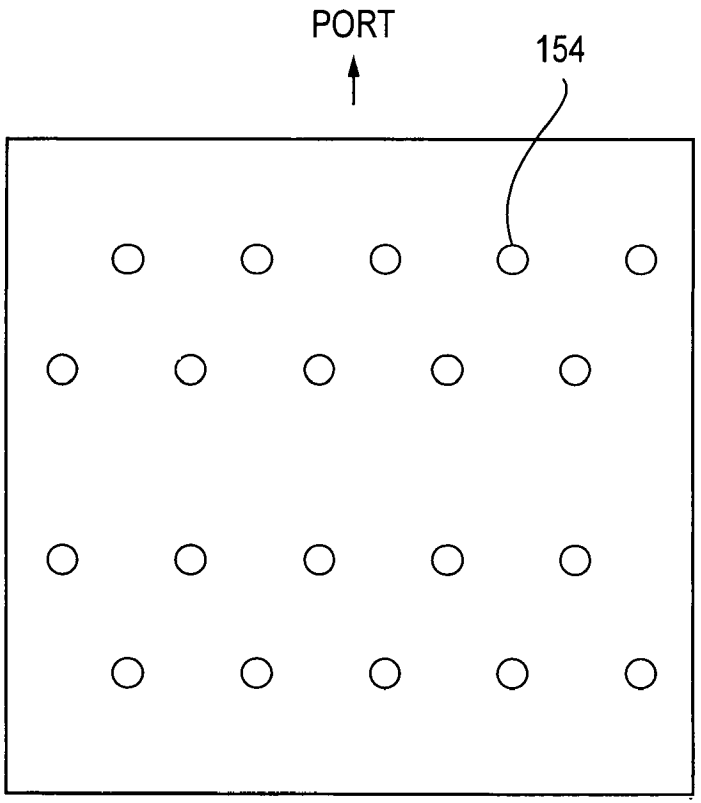
FIG. 1*o* is a plan view of the terminal arrangement of the connector assembly of FIG. 1*i* (10/100).

Referring now to FIGS. 1-1*o*, a first embodiment of the connector assembly of the present invention is described. As shown in FIG. 1, the assembly 100 generally comprises a connector housing element 102 having a plurality of individual connectors 104 formed therein. Specifically, the connectors 104 are arranged in the illustrated embodiment in side-by-side row fashion within the housing 102 such that two rows 108, 110 of connectors 104 are formed, one disposed atop the other ("row-and-column"). The front walls 106*a* of each individual connector 104 are further disposed parallel to one another and generally coplanar, such that modular plugs may be inserted into the plug recesses 112 formed in each connector 104 simultaneously without physical interference. The plug recesses 112 are each adapted to receive one modular plug (not shown) having a plurality of electrical conductors disposed therein in a predetermined array, the array being so adapted to mate with respective conductors 120*a* present in each of the recesses 112 thereby forming an electrical connection between the plug conductors and connector conductors 120*a*, as described in greater detail below.

The rows 108, 110 of the embodiment of FIG. 1 are oriented in mirror-image fashion, such that the latching mechanism for each connector 104 in the top row 108 is reversed or mirror-imaged from that of its corresponding connector in the bottom row 110. This approach allows the user to access the latching mechanism (in this case, a flexible tab and recess arrangement of the type commonly used on RJ modular jacks, although other types may be substituted) of both rows 108, 110 with the minimal degree of physical interference. It will be recognized, however, that the connectors within the top and bottom rows 108, 110 may be oriented identically with respect to their latching mechanisms, such as having all the latches of both rows of connectors disposed at the top of the plug recess 112, if desired.

The connector housing element 102 is in the illustrated embodiment electrically non-conductive and is formed from a thermoplastic (e.g. PCT Thermex, IR compatible, UL94V-0), although it will recognized that other materials, polymer or otherwise, may conceivably be used. An injection molding process is used to form the housing element 102, although other processes may be used, depending on the material chosen. The selection and manufacture of the housing element is well understood in the art, and accordingly will not be described further herein.

As shown in FIGS. 1*a*-1*b*, the connector assembly may also be shielded with, inter alia, an external tin or alloy noise shield 107 of the type well known in the art, or of the configuration described in greater detail subsequently herein.

A plurality of grooves 122 which are disposed generally parallel and oriented vertically within the housing 102 are formed generally within the recess 112 of each connector 104 in the housing element 102. The grooves 122 are spaced and adapted to guide and receive the aforementioned conductors 120 used to mate with the conductors of the modular plug. The conductors 120 are formed in a predetermined shape and held within one of a plurality of conductor or terminal insert assemblies 129 each formed of two sub-assemblies 130, 132 (FIG. 11), the latter also being received within the housing element 102 as shown in FIGS. 1*c* and 1*m*. Specifically, the housing element 102 includes a plurality of cavities 134 formed in the back of respective connectors 104 generally adjacent to the rear wall of each connector 104 and extending forward into proximity of the recesses 112, each cavity 134 being adapted to receive the terminal insert assemblies 129 (either one, two, or more, as described below in various embodiments). The first conductors 120*a* of the substrate/component assemblies 129 are deformed such that when the assemblies 129 are inserted into their respective cavities 134, the upper conductors 120*a* are received within the grooves 122, maintained in position to mate with the conductors of the modular plug when the latter is received within the plug recess 112, and also maintained in electrical separation by the separators 123 disposed between and defining the grooves 122. When installed, the respective terminal inserts 129 are in a substantially juxtaposed arrangement (see FIG. 1*e*).

Each cavity is further adapted to receive an electronics insert assembly 150 of the type generally shown in FIG. 1*f*. It will be recognized that the term "electronics" as used herein does not require that any electronic components or electronics be disposed on or within the assembly 150, albeit a preferred construction. Specifically, the connector assembly of the present invention may be practiced with no electronic components whatsoever for one or more ports if desired.

Referring now to FIGS. 1*d* and 1*f*-1*k*, exemplary configurations of the (electronics) insert elements 150 are described in detail. As shown best in FIGS. 1*d* and 1*f*, the exemplary embodiment of the connector assembly 100 includes a plurality of insert assemblies 150 that are received substantially within the rear cavities 134 of the housing 102. These assemblies include an upper substrate 140 and a plurality of upper terminals 152 and lower terminals 154, the latter which in the illustrated embodiment are separate components, although it will be recognized that they may be made unitary if desired (e.g., in a one-piece "pass through" configuration which traverses the thickness of the insert element body 151). Alternatively, one or both sets of terminals (or even individual ones of the terminals within a set) can be configured in a different fashion, such as for example using a surface mount technique (e.g., akin to a ball grid array or BGA semiconductor package). It will be appreciated that the terms "upper" and "lower" as used herein are meant in a completely relative sense, and are not in any way limiting or indicative of any preferred orientation. For example, where the connector assembly is installed on the underside of a substantially horizontal motherboard, the "upper" terminals would actually be disposed below the "lower" terminals.

The exemplary terminals shown in FIGS. 1*d* and 1*f*-1*k* are insert-molded into the two insert body elements 156, 158 which form the insert element body 151, although these may be fixed using an adhesive, inserted after molding, use of "staking", etc. Furthermore, the two body elements 156,158 may be formed using any number of processes including, e.g., injection molding or transfer molding.

The upper substrate 140 includes a plurality of apertures 144 to receive the upper terminals 152, and may be populated on one or both surfaces with any manner of electronic components (whether discrete components such as resistors, capacitors, etc. or integrated circuits), conductive traces, etc. The upper substrate 140 also includes a distal portion 145 which has a series (e.g., eight) conductive traces 146 disposed on its surfaces (both upper and lower) so as to cooperate with corresponding ones of the rear-most ends of the conductors 120*a*, 120*b* of the terminal insert assembly 129, as shown best in FIG. 1*m*. The upper substrate 140 may be a single-layer board, or alternatively comprise a multi-layer board having a plurality of vias or other electrical pathways formed therein as is well known in the electronic arts.

When assembled, each individual insert assembly 150 is "ganged" with its adjacent port-pair neighbor (if any) as shown in FIG. 1*d*. Specifically, the individual assemblies 150 are mated to a common lower substrate 170 using a set of complementary frictional or snap pins 173 on the insert body elements 156, 158 and holes 174 formed in the lower substrate, although other means (such as via soldering the lower terminals 154, adhering the assemblies 150 to the substrate 170, heat staking, or another such approaches) may be used if desired. It will be recognized, however, that other configurations may be used, including without limitation: (i) having each insert assembly 150 and its upper and lower substrates comprise an individual unit, thereby making each assembly 150 for each port-pair independently removable; (ii) using both common upper and lower substrates for each pair of insert assemblies 150; or (iii) using common upper and/or lower substrates for more than two insert assemblies 150 (such as where all four inserts 150 of a 2×4 configuration are commonly "ganged" onto one common lower substrate 170 that is received in one large cavity 134 formed in the back end of the connector housing 102. Several other approaches are possible, each being readily recognized and implemented by those of ordinary skill provided the present disclosure.

The lower substrate(s) 170 are disposed in the illustrated embodiment on the bottom face of the connector assembly 100 adjacent to the PCB or external device to which the assembly 100 is ultimately mounted. Each substrate 170 comprises, in the illustrated embodiment, at least one layer of fiberglass, although other arrangements and materials may be used. The substrate 170 further includes a plurality of conductor perforation arrays formed at predetermined locations on the substrate 170 with respect to the lower conductors 154 of each insert assembly 150 such that when the connector assembly 100 is fully assembled, the conductors 154 penetrate the substrate 170 via respective ones of the aperture arrays. This arrangement advantageously provide mechanical stability and registration for the lower conductors 154, as well as stability for the insert assemblies 150.

Figure 1N:
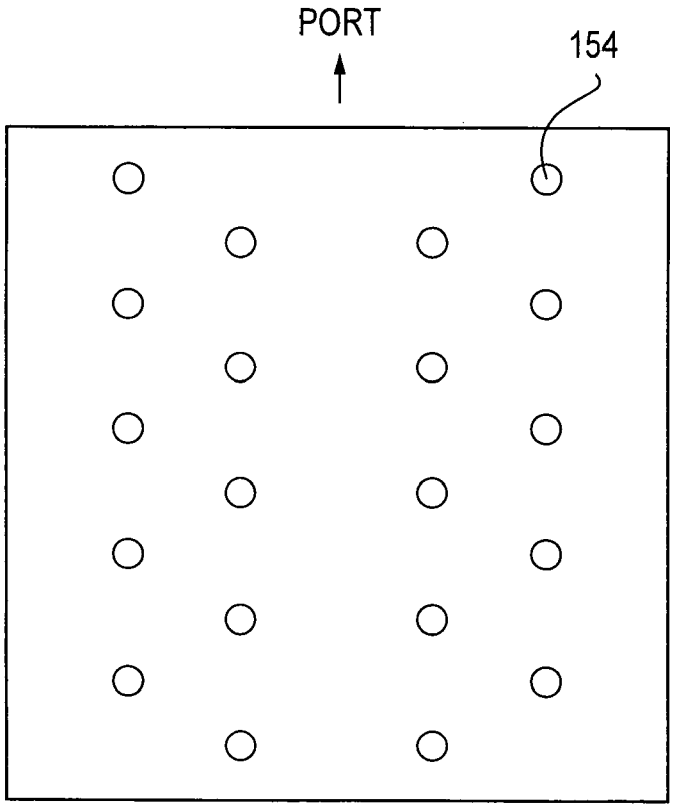
FIG. 1*n* is a plan view of the terminal arrangement of the connector assembly of FIG. 1 (GBE).

One salient attribute of the present invention relates to its ability to be used in a number of different configurations and/or applications. Specifically, as shown in FIGS. 1*f*-1*h* and 1*i*, the connector assembly can include lower terminals 154 disposed in one or multiple substantially parallel rows running fore-to-aft (i.e., along lines running from the front face 106 to the rear of the housing 102), such as is typically used in gigabit Ethernet (GBE) or other applications; see FIG. 1*n* for a plan view of this lower terminal configuration. Alternatively, as shown in FIGS. 1*l*, 1*k*, and 1*o*, the insert assembly 150 can be configured with the lower terminals 154 disposed in one or more substantially parallel rows disposed perpendicular to those previously described, as is typically used in many 10/100 Ethernet applications. Myriad other configurations of the lower terminals (including mixtures of the two approaches described above) can be employed as desired, such as for custom terminal pin-outs.

Notably, the illustrated embodiments previously described also use a common configuration for the upper terminals 152 of the insert assemblies 150, so that the upper substrate 140 which is disposed atop the insert assembly 150 need not be changed for each different insert assembly configuration. Hence, the exemplary connector assembly 100 can be configured as either a GBE device, a 10/100 device, or otherwise simply by inserting a different configuration of the insert assembly 150 within the housing 102. This simplifies manufacturing, since the housings 104, terminal inserts 129, upper substrates 140, noise shields, etc. are identical for each different variant; the only change relates to the insert assembly 150 and the lower substrate(s) 170.

In fact, the lower substrates 170 may be either (i) completely obviated in certain embodiments or applications, or (ii) made also to be "universal" by having perforations for both GBE and 10/100 pin-outs such that the same lower substrate 170 can be used with either insert element 150. This can be accomplished for example by aligning the various components including the lower terminals and insert bodies 156, 158 to meet the pin-out requirements, and then placing the perforations in the lower substrate 170 such that they both meet both of the pin-outs, and utilize at least some of the same perforations for either application.

It will also be recognized that a given insert assembly 150 can itself be made "universal". In one embodiment of the invention (FIGS. 1*p* and 1*q*), each insert assembly body 156, 158 is configured such that it is effectively square, and therefore can be inserted into the housing 102 in either a first or second orientation (each orientation being rotated 90-degrees from the other). The upper substrate 140 (FIG. 1*r*) is designed to remain in the same orientation regardless of the orientation of the insert assembly body, and accordingly has two sets of substantially identical perforations 144 formed therein such that the upper terminals 152 of the insert element body can be received in one set or another of the perforations regardless of the orientation of the insert body. The lower terminals 154 (FIG. 1*q*) are accordingly disposed in either the GBE orientation or the 10/100 (or whatever other pin-outs of significance are chosen) depending on how the insert body is inserted into the housing.

It is noted also that the electronics package utilized within the insert assembly 150 can be made to accommodate both variants (i.e., GBE or 10/100) by the use of additional or extra electronic components (e.g., magnetics) to account for either use, and/or by making the electronics serve a dual-purpose where possible. Alternatively, individual ones of the insert assemblies 150 designed for GBE applications can be wired/equipped one way, and those destined for 10/100 applications wired/equipped another, since even the use of "universal" insert assembly body elements 156, 158 reduces manufacturing costs since only one type of insert assembly (albeit wired and equipped differently) is needed.

In the illustrated embodiments, one or more types of electronic components are disposed within the interior cavity 180 formed within each insert assembly 150, including e.g., choke coils, transformers, etc. (see FIG. 1*j*). These components have their wires in electrical communication with one or more of the upper and lower terminals 152, 154 of the assembly 150, such as via wire-wrapping, soldering, welding, or the like. A plurality of wire channels 184 are also provided to aid in wire routing and separation. The terminals 152, 154 may also be notched as is well known in the art to further facilitate bonding of the wires thereto. The electronic components may also be encapsulated within a potting compound or encapsulant such as epoxy or silicone gel, if desired. The two body elements 156, 158 are snapped together using a pin-hole arrangement as shown in FIG. 1*j*, although it will be appreciated that other mechanisms may be used such as adhesives, thermal bonding, etc. Furthermore, it will be recognized that the insert body may be formed as a unitary component (e.g., with an opening to insert the various electronic components, or as a sold block of plastic or encapsulant) rather than in "halves" as shown.

In another embodiment, an interlock base or comparable component is used inside of the cavity 180 for, inter alia, additional electrical separation.

In yet another embodiment (not shown), the insert assembly 150 can be split top-and-bottom, such that the two body elements 156, 158 are disposed in substantially over/under arrangement. The upper terminals 152 are hence insert molded or otherwise disposed within the upper body element, while the lower terminals 154 are formed or disposed in the lower body element.

The terminal insert assemblies 129 are retained within their cavities 134 substantially by way of friction with the housing element 102, although other methods and arrangements may be substituted with equal success. The illustrated approach allows for easy insertion of the completed terminal assemblies 129 into the housing 102, and subsequent selective removal if desired.

FIG. 11 best shows the construction of the terminal assemblies 129, comprising the two sub-assemblies 130, 132. In the illustrated embodiment, the two sub-assemblies are held together by at least a friction locating pin 133 or heat stake arrangement, although other arrangements readily apparent to those of ordinary skill can be used (such as adhesives). Alternatively, the two sub-assemblies can be formed as one unitary component if desired.

The embodiment of FIG. 1*l* uses insert-molded terminals (conductors) 120 of the type well known in the connector arts, although other arrangements can be used, including inserting the unformed leads into the sub-assemblies 130, 132 after formation and then subsequently forming the conductors 120.

It will also be recognized that separators or EMI shields can be disposed between the conductor sets of any given terminal insert assembly 129 (or between adjacent ones of the juxtaposed assemblies 129) so as to minimize electrical noise and cross-talk between the conductor sets 120*a*, 120*b* and/or between other components. For example, the multi-dimensional shielding apparatus and techniques described in U.S. Pat. No. 6,585,540 to Gutierrez, et al. issued Jul. 1, 2003 entitled "Shielded microelectronic connector assembly and method of manufacturing" and incorporated herein by reference in its entirety may be used consistent with the present invention, with proper adaptation. Other shielding configurations may also be used, the foregoing being but one option. Furthermore, other techniques well known in the electronic arts for minimizing EMI and/or cross-talk may be used consistent with the invention if desired.

The inserts 129 are also provided with optional locking mechanisms 135 to lock them into their channels within the housing 102, although this can also be accomplished using friction, heat staking, or another means.

In the illustrated embodiment, the two sets of conductors 120*a*, 120*b* for each terminal insert 129 are disposed relative to one another in substantially mirror image, although this is by no means a requirement. Use of mirror-image sets of conductors can significantly simplify the manufacturing process, since formation and handling of heterogeneous conductor configurations are obviated. However, there are applications where it may be desirable to use such heterogeneous configurations, such as where the two connectors in the port-pair are heterogeneous, or where the internal structure of the assembly 100 dictates such a configuration.

Figure 1Q:
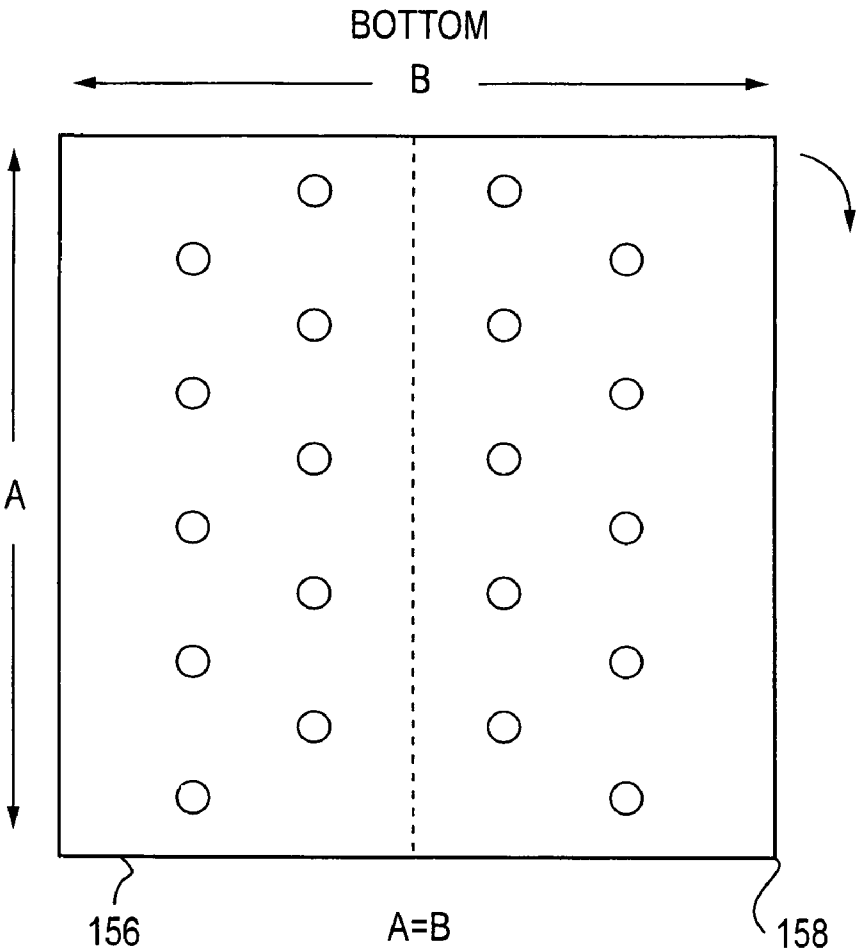
FIG. 1*q* is a bottom plan view of the insert assembly of FIG. 1*p* showing the "universal" GBE and 10/100 pin configurations.
Figure 1P:
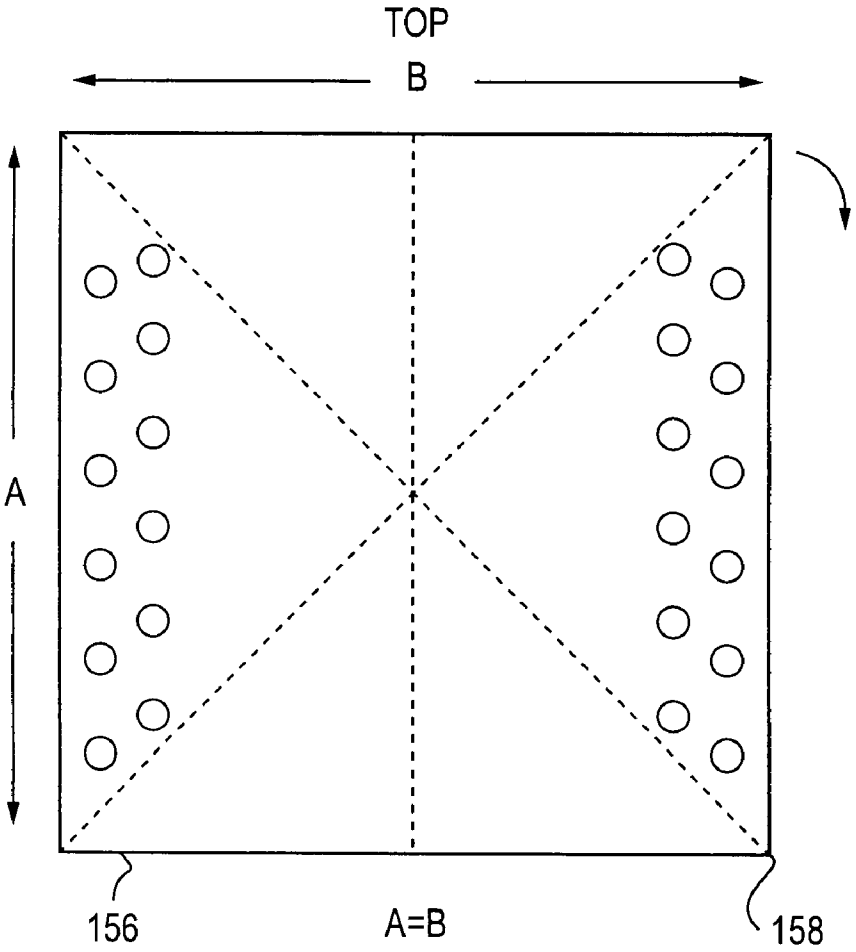
FIG. 1*p* is a top plan view of the terminal arrangement of yet another embodiment of the electronics insert assembly, showing multiple upper terminal arrays.
Figure 1R:
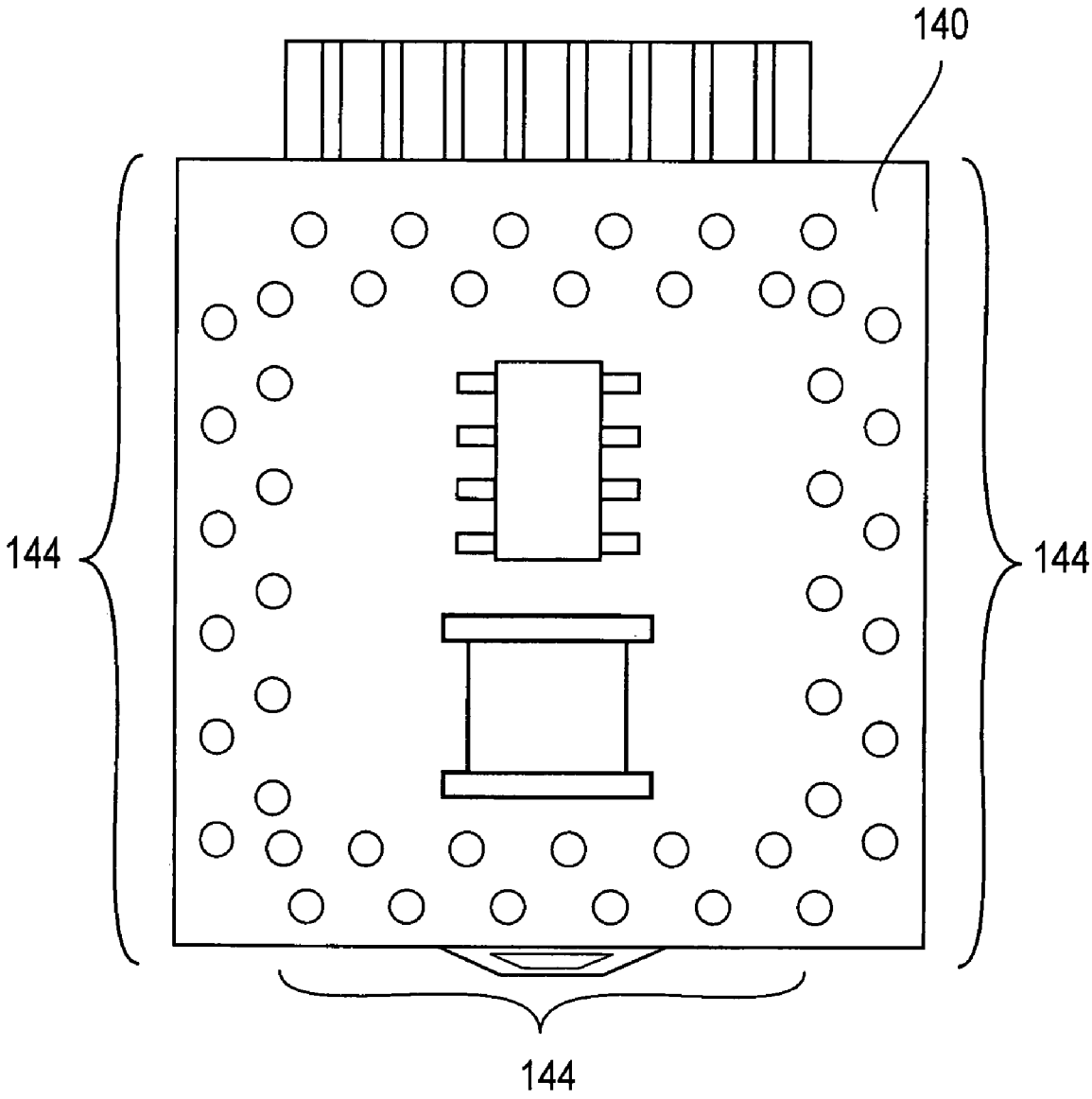
FIG. 1*r* is a top plan view of an exemplary upper substrate configuration useful with the insert assembly of FIGS. 1*p* and 1*q*.
Figure 1S:
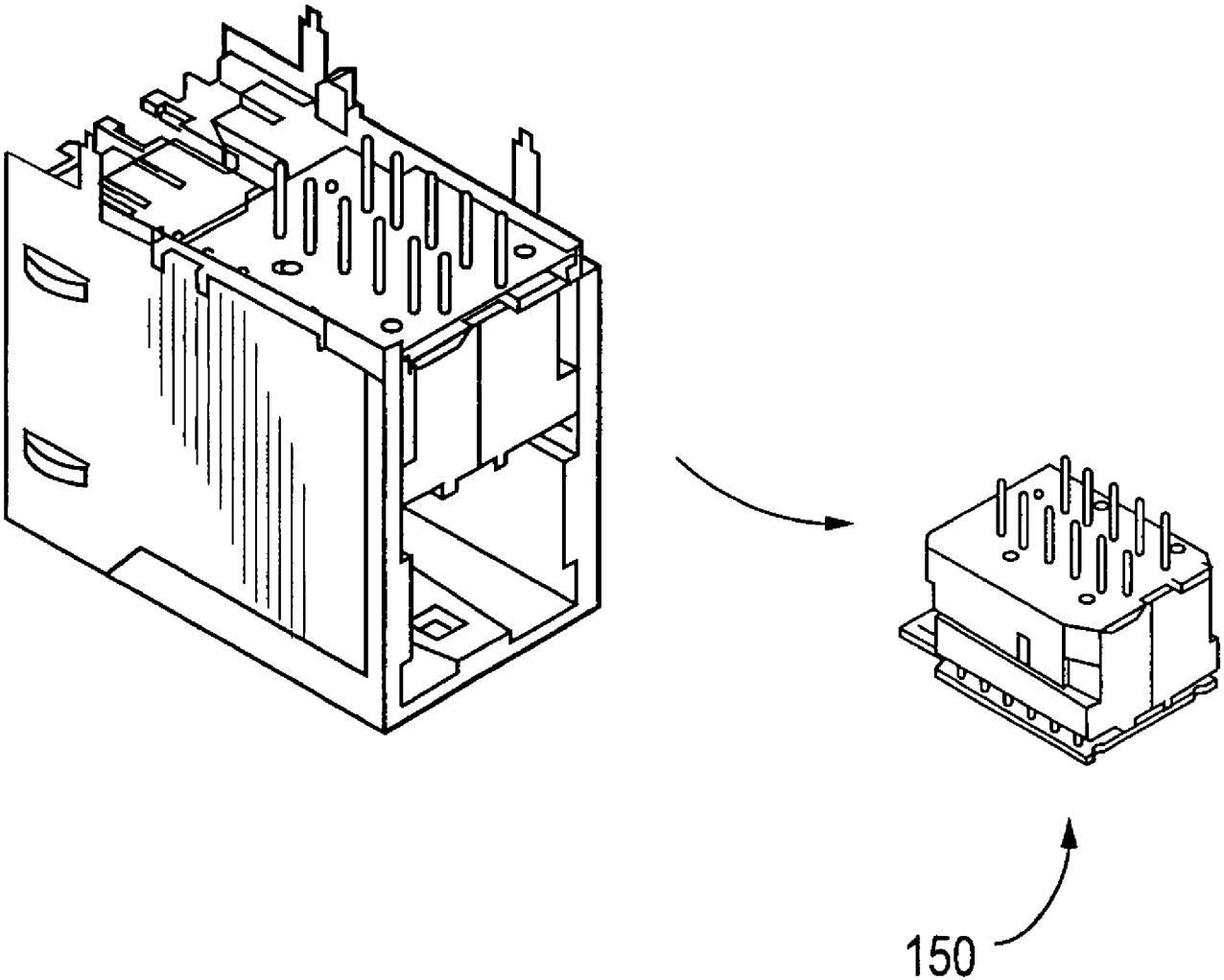
FIG. 1*s* is a rear perspective view of another exemplary embodiment (2×1, for Gigabit Ethernet) of the connector assembly according to the present invention.

It is further noted that while the embodiment of FIGS. 1-1*q* comprises two rows 108, 110 of four connectors 104 each (thereby forming a 2 by 4 array of connectors), other array configurations may be used. For example, a 2 by 2 array comprising two rows of two connectors each could be substituted. Alternatively, a 2 by 8 arrangement could be used. A 2×1 array (FIG. 1*s*) may also be used. As yet another alternative, an asymmetric arrangement may be used, such as by having two rows with an unequal number of connectors in each row (e.g., two connectors in the top row, and four connectors in the bottom row). The modular plug recesses 112 (and front faces 106*a*) of each connector also need not necessarily be coplanar as in the embodiment of FIG. 1. Furthermore, certain connectors in the array need not have lower substrates/electronic components, or alternatively may have components disposed in the insert assemblies 150 and/or on the substrates different than those for other connectors in the same array.

As yet another alternative, the connector configurations within the connector housing may be heterogeneous or hybridized. For example, one or more of the upper/lower row port pairs may utilize configurations which are different from those used for other port pairs, such as where the electronics package for one port-pair is different than that for another port-pair within the same connector assembly 100. Alternatively, individual ports within a pair can have heterogeneous configuration. As yet another alternative, port-pairs can be intermixed, such as where two of the four insert assemblies 150 used in the 2×4 configuration of FIG. 1 are configured for GBE, while the other two are configured for 10/100 or another standard.

Many other permutations are possible consistent with the invention; hence, the embodiments shown herein are merely illustrative of the broader concept.

Single Port Embodiment

Figure 2:
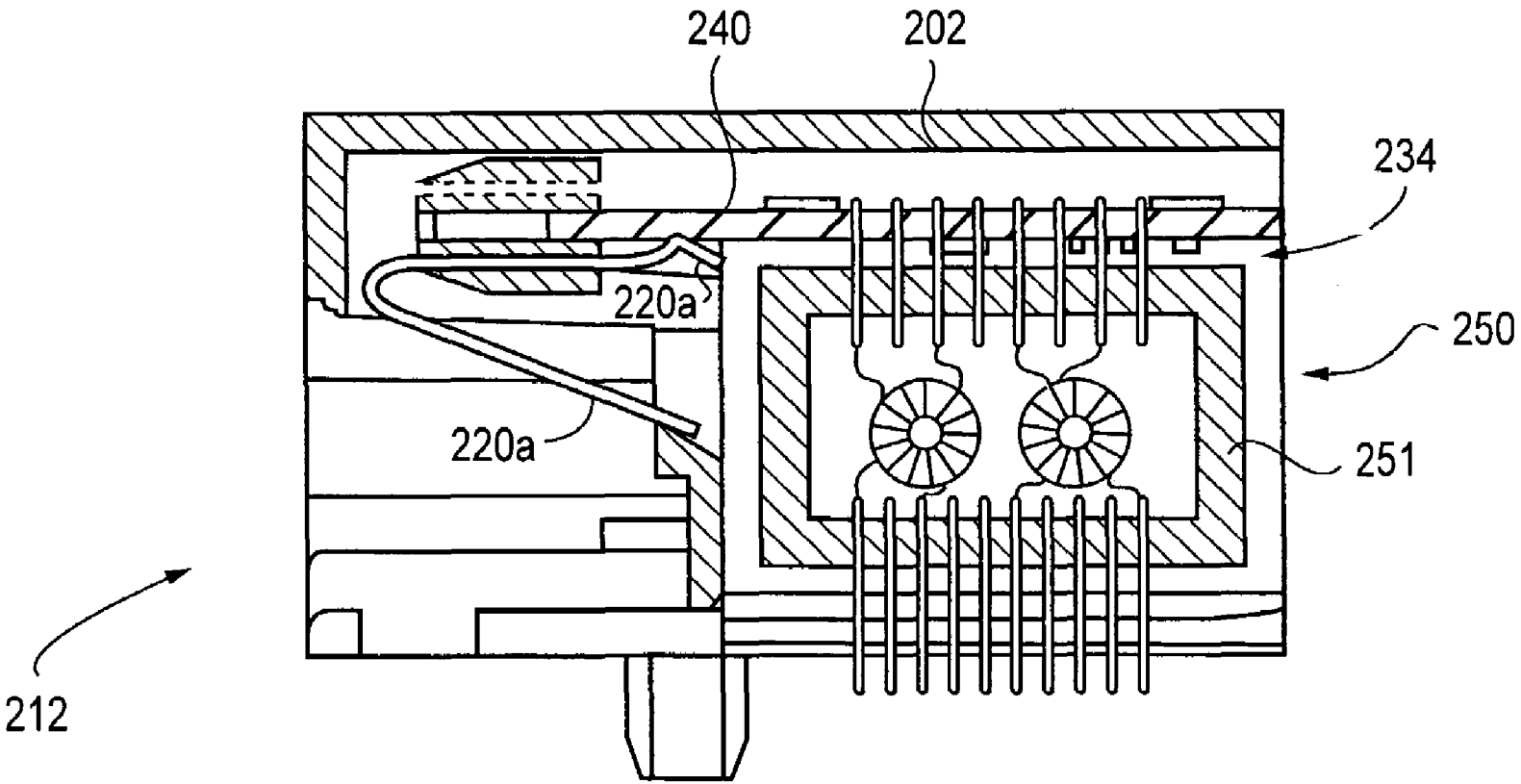
FIG. 2 is a rear perspective view of a second exemplary embodiment (single port) of the connector assembly according to the present invention.
Figure 3A:
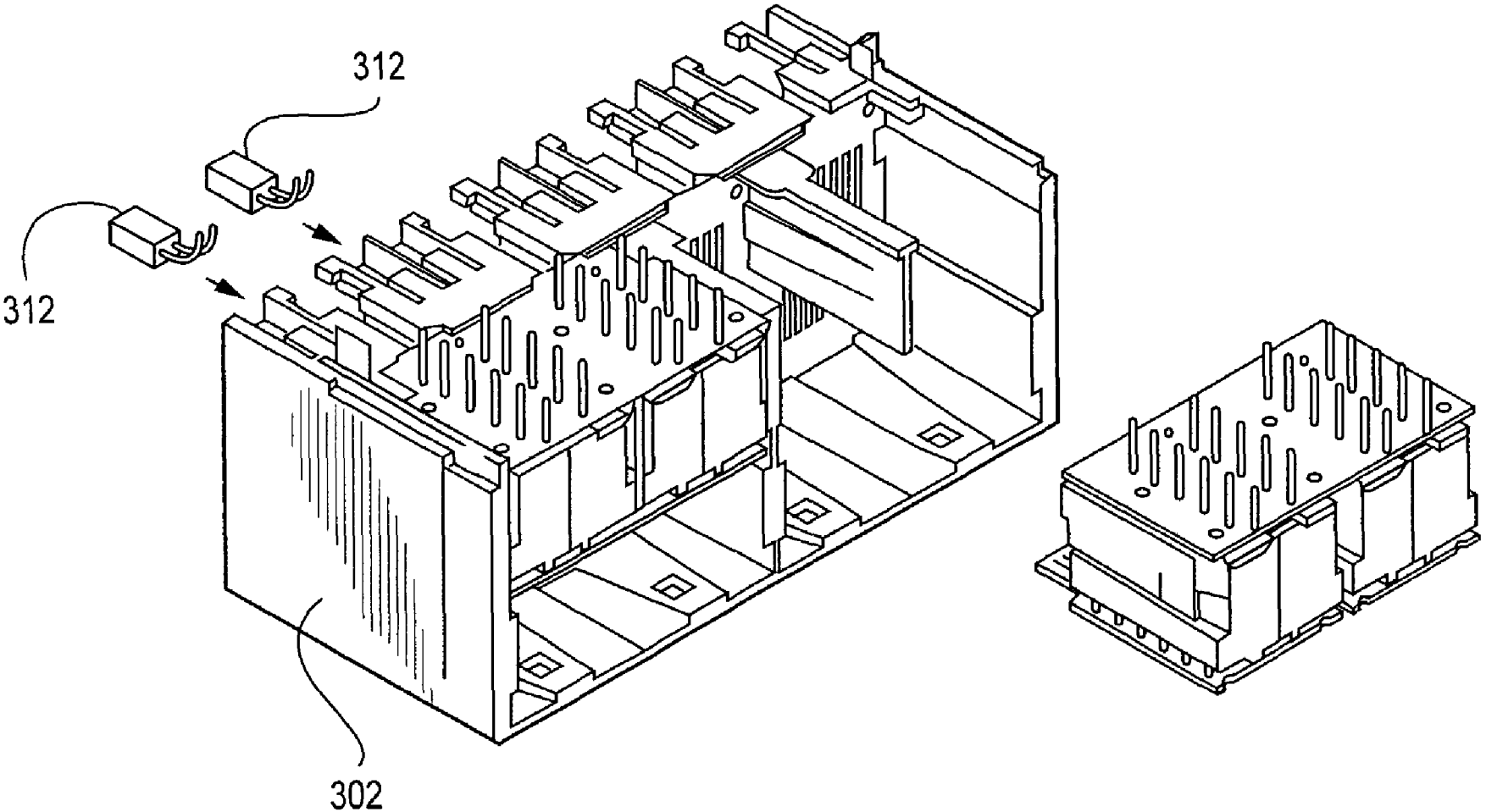
FIGS. 3*a*-3*d* are various rear perspective views of another exemplary embodiment (2×4) of the connector assembly according to the present invention, including one configuration of indicating means.
Figure 3B:
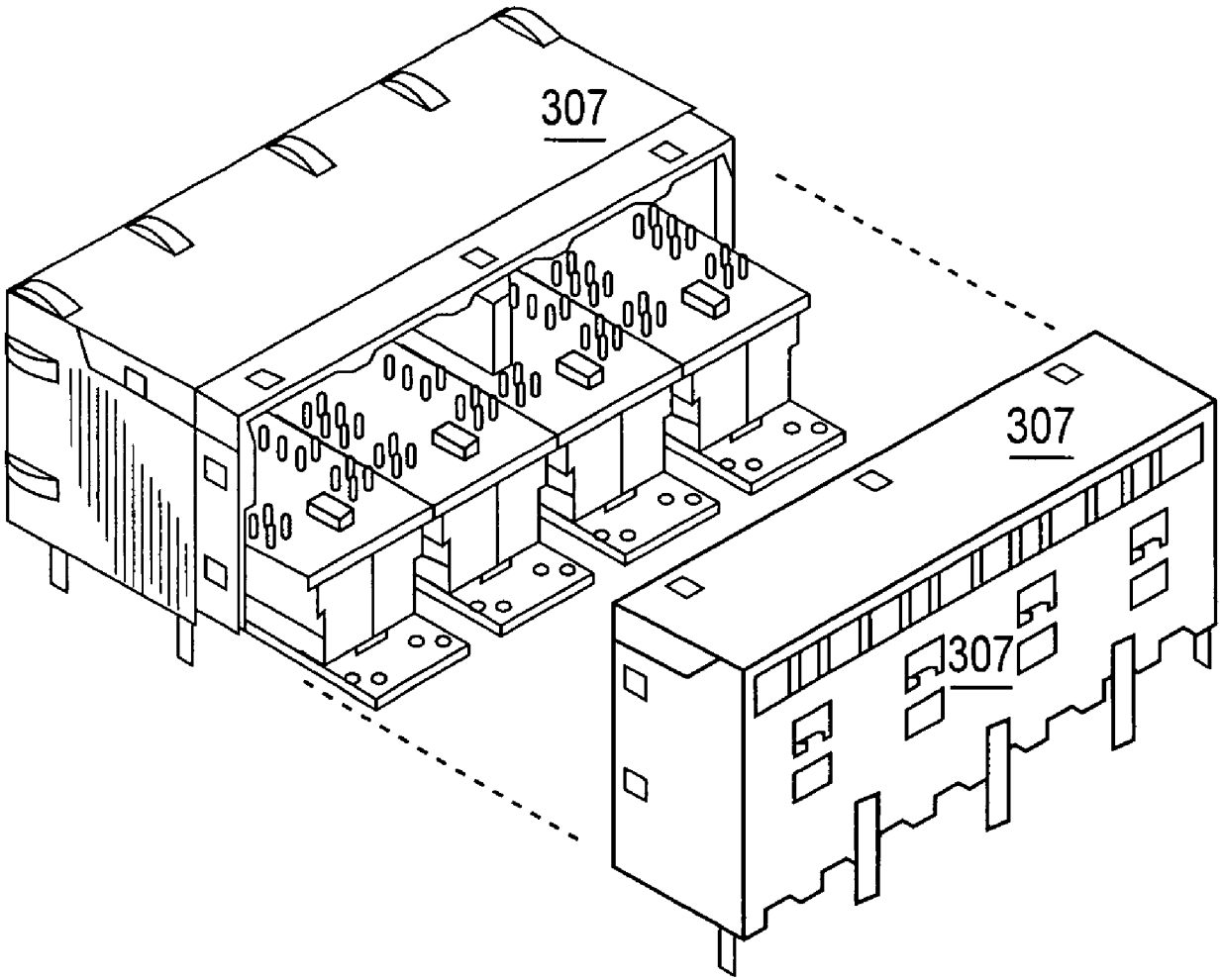
Figure 3C:
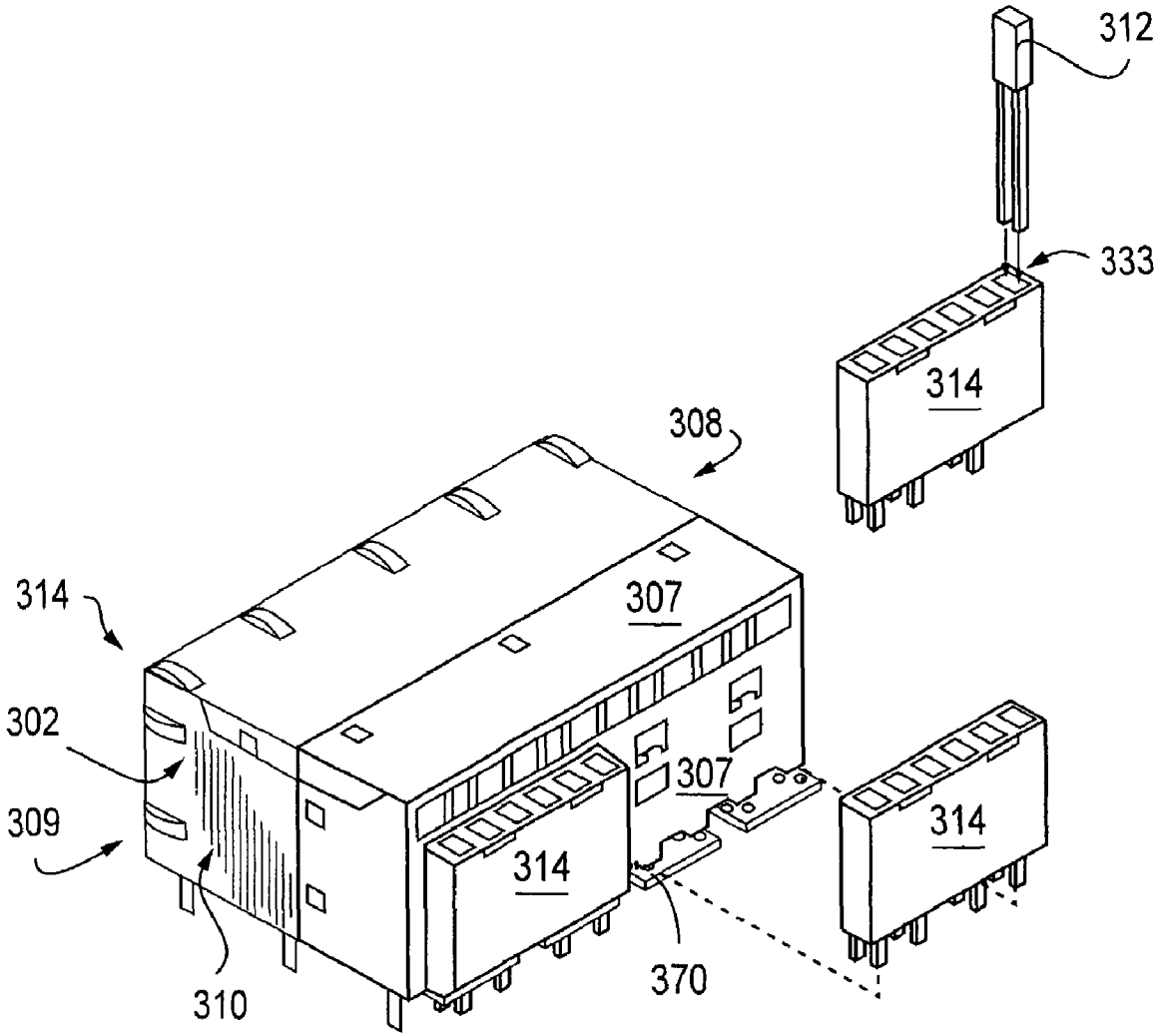
Figure 3D:
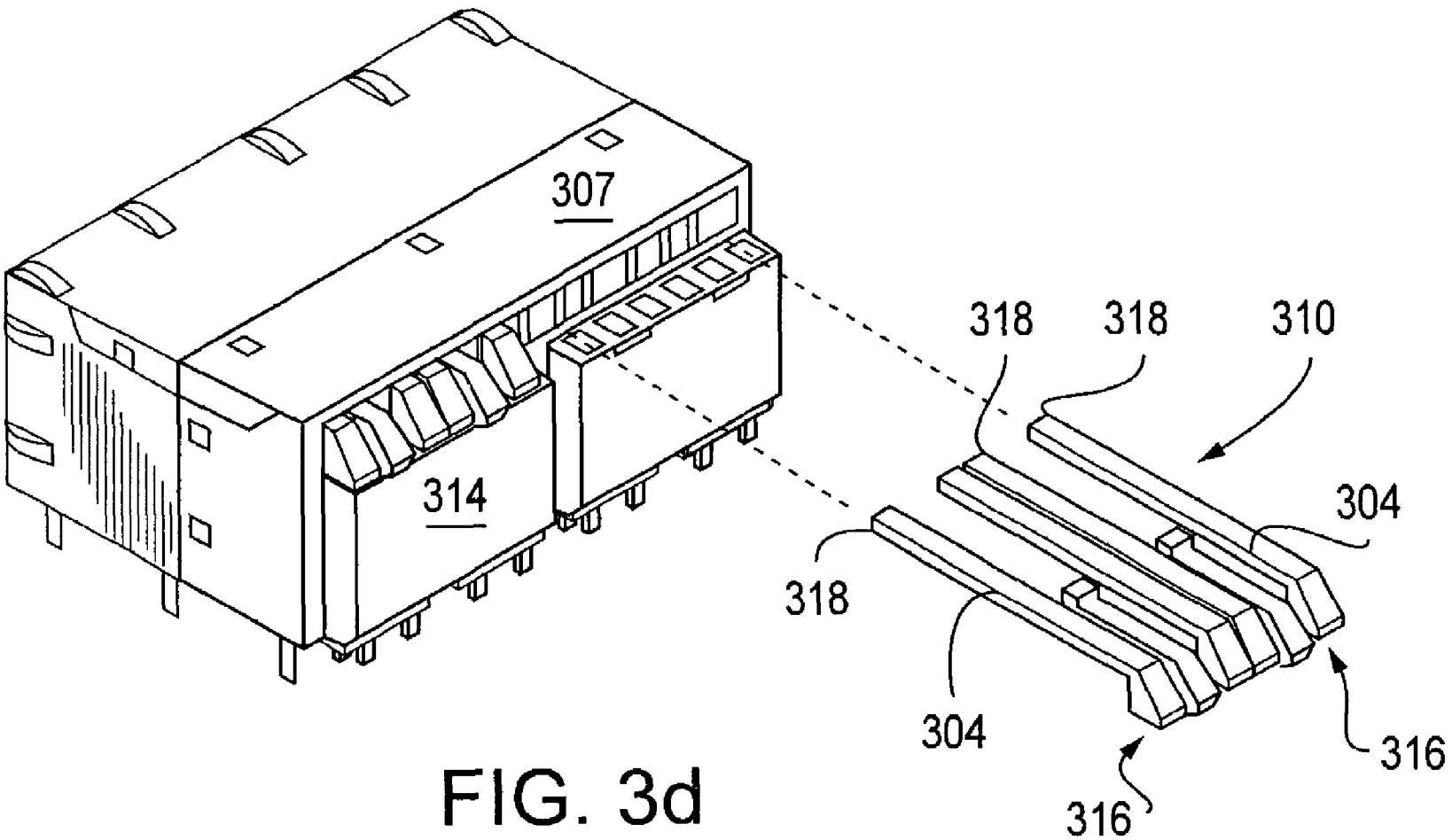

Referring now to FIG. 2, another embodiment of the connector assembly of the present invention is described. As shown in FIG. 2, the assembly 200 generally comprises a connector housing element 202 having one modular plug-receiving connector 204 formed therein. The front wall 206*a* of the connector 204 is further disposed generally perpendicular or orthogonal to the PCB surface (or other device) to which the connector assembly 200 is mounted, with the latch mechanism located away from the PCB, such that modular plugs may be inserted into the plug recess 212 formed in the connector 204 without physical interference with the PCB. The plug recess 212 is adapted to receive one modular plug (not shown) having a plurality of electrical conductors disposed therein in a predetermined array, the array being so adapted to mate with respective conductors 220*a* present in the recess 212 thereby forming an electrical connection between the plug conductors and connector conductors 220*a*. This embodiment can be thought of in a broad sense as being only one port of only the lower portion of the connector 100 of FIG. 1*m*. Specifically, the upper substrate 240 has traces, components, etc. disposed on its lower surface in order to conserve vertical profile (although this is not a requirement), and the substrate 240 disposed atop a streamlined body 251 similar to the insert assembly 150 of the connector 100 of FIG. 1. Specifically, since the connector 200 has only one port, the signal conditioning/electronics requirements are proportionately less, and hence the insert assembly 250 (and cavity 234) can be made smaller and more compact if desired. Also, reduced height upper terminals can be used to reduce vertical profile, or alternatively another interface mechanism (such as BGA or the like) can be employed. Hence, the connector assembly 200 of FIG. 2 can optionally have the form factor (and footprint) of a conventional RJ or similar jack if desired.

Referring now to FIGS. 1-1*c* and 1*f*, another aspect of the invention is described. Specifically, as best shown in the foregoing Figures, the connector assembly 100 optionally includes an external noise shield 107 disposed substantially around the exterior of the connector 100. The exemplary shield 107 comprises a two piece construction (although more or less pieces may be used), and includes a plurality of "clips" 191 formed in the rear of the shield (see FIGS. 1*a* and 1*c*). These clips 191 are adapted to connect electrically with corresponding pads or contacts 192 on the upper substrate 140 when the rear shield component is placed over the rear of the connector housing 102. The contacts 192 are electrically connected to a capacitor disposed on, e.g., the upper substrate, thereby providing a low impedance path to ground through the shield. These clips 191 and contacts 192 may be purely a friction fit, soldered or otherwise mechanically bonded, or both, as desired.

As shown in FIG. 1*a*, the rear shield element ground tabs 193 slide between the lower substrate 170 and the insert assembly 150. Also, the front tabs 194 of the shield (FIG. 1*b*) slide within grooves formed on the bottom of the housing and under the lower substrate 170 as well, thereby securing the shield 170 to the housing. These tabs are also optionally connected electrically to the lower substrate 170 (e.g., contact pads formed on the top or bottom surface thereof) in order to provide a ground connection similar to the for the clips 191 previously discussed. Such connection may be frictional, via a bonding process such as soldering, or otherwise.

It is noted that the aforementioned shield can also be adapted to accommodate various component packages disposed at the rear of the connector assembly, for example the illuminating means shown in FIGS. 3*a*-3*d*, described subsequently herein.

Connector Assembly with Light Sources

Figure 4:
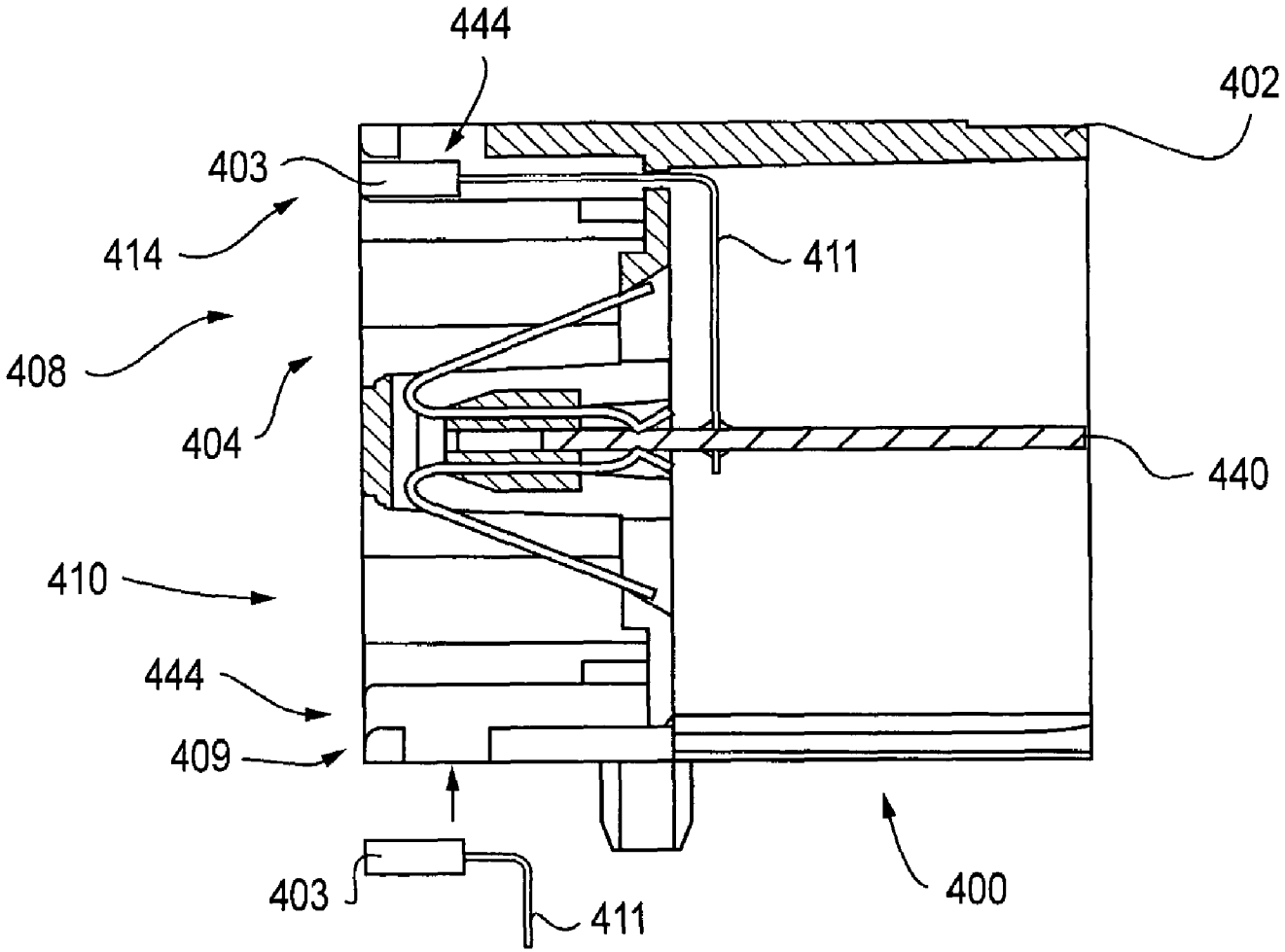
FIG. 4 is a side cross-sectional view of yet another exemplary embodiment (2×4) of the connector assembly according to the present invention (shown unshielded, and with electronics inserts and various components removed for clarity), including another configuration of indicating means.

Referring now to FIGS. 3 and 4, yet other embodiments of the connector assembly of the present invention are described.

As shown in FIGS. 3*a*-3*d*, another embodiment of the connector 300 includes light sources comprising a light pipe arrangement. Light pipes are generally known in the art; however, the arrangement of the present invention adapts the light pipe to the connector configurations otherwise disclosed herein. Specifically, as shown in FIGS. 3*a*-3*d*, the illustrated embodiment comprises a two-row connector assembly (i.e., at least one upper row connector and at least one lower row connector) having one or more light pipe assemblies 310 associated therewith. For the upper row connector 302, the light pipe assembly 310 comprises an optically conductive medium 304 adapted to transmit the desired wavelength(s) of light energy from a light source 312, in this case an LED. The LED 312 is disposed within a carrier element 314 disposed proximate to the back surface of the connector assembly which is adapted and sized to receive the LED(s). The carrier 314 can accommodate a number of LEDs or similar sources as shown. The LED conductors are mated to the lower substrate 370, which projects somewhat out the back of the connector assembly 300 as shown best in FIG. 3*c*.

Note that the LED recesses 333 within the carrier 314 may also be coated internally with a reflective coating of the type well known in the art to enhance the reflection of light energy radiated by the LED during operation into the interior face of the optical medium 304. The optically conductive medium may comprise a single unitary light path from the interior face 316 to the viewing face 318, or alternatively a plurality of abutted or joined optically transmissive segments. As yet another approach, one or more "ganged" optical fibers (e.g., single mode or multimode fibers of the type well known in the optical networking arts) may be used as the optical medium. As yet another alternative, a substantially prismatic device may be used as the optical medium 304, especially if substantial chromatic dispersion is desired. The optical medium may be removably retained within the connector assembly housing, or alternatively fixed in place (such as by being molded within the housing, or retained using an adhesive or friction), or any combination of the foregoing as desired.

The light pipe assembly 310 is disposed within the upper portion of the connector housing within a channel formed therein. It will be noted that due to the longer optical "run" and greater optical losses associated with this second optical medium, the size/intensity of the LED 312, and/or the optical properties or dimensions of the medium 304, may optionally be adjusted so as to produce a luminosity substantially equivalent to that associated with the LEDs for the bottom row.

Also, the LEDs for the bottom row can be used with a lens, prism, or optical medium (albeit much shorter in length than that for the upper row of connectors) if desired in order to provide a homogeneous appearance for the indicators of the top and bottom rows of connectors.

It will also be appreciated that while the embodiment of FIG. 3*a*-3*d* is shown with an exemplary external noise shield 307, this shield is optional, or may comprise another configuration if desired, including one which is external to the LEDs and optical indicators. Placing of the LEDs outside of the noise shield also helps mitigate interference between the LEDs and the signal paths/electronic components within the connector.

It can also be appreciated that while the foregoing embodiment is described in terms of a two-row connector device, the light pipe assemblies of the invention may also be implemented in devices having other numbers of rows, such as for example with a 1×N device.

In another variant, the light pipe configuration of the type shown in co-owned and co-pending U.S. patent application Ser. No. 10/246,840 filed Sep. 18, 2002 entitled "Advanced Microelectronic Connector Assembly and Method of Manufacturing", incorporated herein by reference in its entirety, can be used consistent with the invention in order to provide indication functionality.

In the alternate embodiment of FIG. 4, the connector assembly 400 comprises a plurality of light sources 403, presently in the form of light emitting diodes LEDs of the type well known in the art. The light sources 403 are used to indicate the status of the electrical connection within each connector, as is well understood. The LEDs 403 of the embodiment of FIG. 4 are disposed at the bottom edge 409 of the bottom row 410 and the top edge 414 of the top row 408 two LEDs per connector, adjacent to and on either side of the modular plug latch mechanism, so as to be visible from the front face of the connector assembly 400. The individual LEDs 403 are, in the present embodiment, received within recesses 444 formed in the front face of the housing element 402. The LEDs each include two conductors 411 which run from the rear of the LED to the rear portion of the connector housing element 402 generally in a horizontal direction within lead channels formed in the housing element. The LED conductors 411 are sized and deformed at such an angle towards their distal ends such that they can either (i) mate with respective apertures formed on the primary substrate(s) associated with each modular plug port, the conductors then being in electrical communication with respective second conductors disposed at the other end of the primary substrate, (ii) run uninterrupted to the upper substrate 440 (i.e., one continuous conductor), and penetrate therethrough and emerge from corresponding apertures formed in the substrate 440, or (iii) run directly from the LED to the PCB/external device without regard to or interaction with the upper substrate.

Similarly, a set of complementary grooves are provided, such grooves terminating on the bottom face of the housing 402 coincident with the conductors 411 for the LEDs of the bottom row of connectors. These allow the LED conductors to be received within their respective recesses 444, and upon emergence from the rear end of the recess 444, be deformed downward to be frictionally received within their respective grooves.

The recesses 444 formed within the housing element 402 each encompass their respective LED when the latter is inserted therein, and securely hold the LED in place via friction between the LED 403 and the inner walls of the recess (not shown). Alternatively, a looser fit and adhesive may be used, or both friction and adhesive. As yet another alternative, the recess 444 may comprise only two walls, with the LEDs being retained in place primarily by their conductors 411, which are frictionally received within grooves formed in the adjacent surfaces of the connector housing. As yet another alternative, the external shield element 107 may be used to provide support and retention of the LEDs within the recesses 444, the latter comprising three-sided channels into which the LEDs 403 fit. Many other configurations for locating and retaining the LEDs in position with respect to the housing element 402 may be used, such configurations being well known in the relevant art.

The two LEDs 403 used for each connector 404 radiate visible light of the desired wavelength(s), such as green light from one LED and red light from the other, although multi-chromatic devices (such as a "white light" LED), or even other types of light sources, may be substituted if desired. For example, a light pipe arrangement such as that using an optical fiber or pipe to transmit light from a remote source to the front face of the connector assembly 400 may be employed. Many other alternatives such as incandescent lights or even liquid crystal (LCD) or thin film transistor (TFT) devices are possible, all being well known in the electronic arts.

The connector assembly 400 with LEDs 403 may further be configured to include noise shielding for the individual LEDs if desired. Note that in the embodiment of FIG. 4, the LEDs 403 are positioned inside of (i.e., on the connector housing side) of the external noise shield 107 (not shown). If it is desired to shield the individual connectors 404 and their associated conductors and component packages from noise radiated by the LEDs, such shielding may be included within the connector assembly 300 in any number of different ways. In one embodiment, the LED shielding is accomplished by forming a thin metallic (e.g., copper, nickel, or copper-zinc alloy) layer on the interior walls of the LED recesses 444 (or even over the non-conductive portions of LED itself) prior to insertion of each LED. In a second embodiment, a discrete shield element (not shown) which is separable from the connector housing 402 can be used, each shield element being formed so as to accommodate its respective LED and also fit within its respective recess 444. In yet another embodiment, the external noise shield may be fabricated and deformed within the recesses 444 so as to accommodate the LEDs 403 on the outer surface of the shield, thereby providing noise separation between the LEDs and the individual connectors 404. Myriad other approaches for shielding the connectors 404 from the LEDs may be used as well if desired, with the only constraint being sufficient electrical separation between the LED conductors and other metallic components on the connector assembly to avoid electrical shorting.

Method of Manufacture

Figure 5:
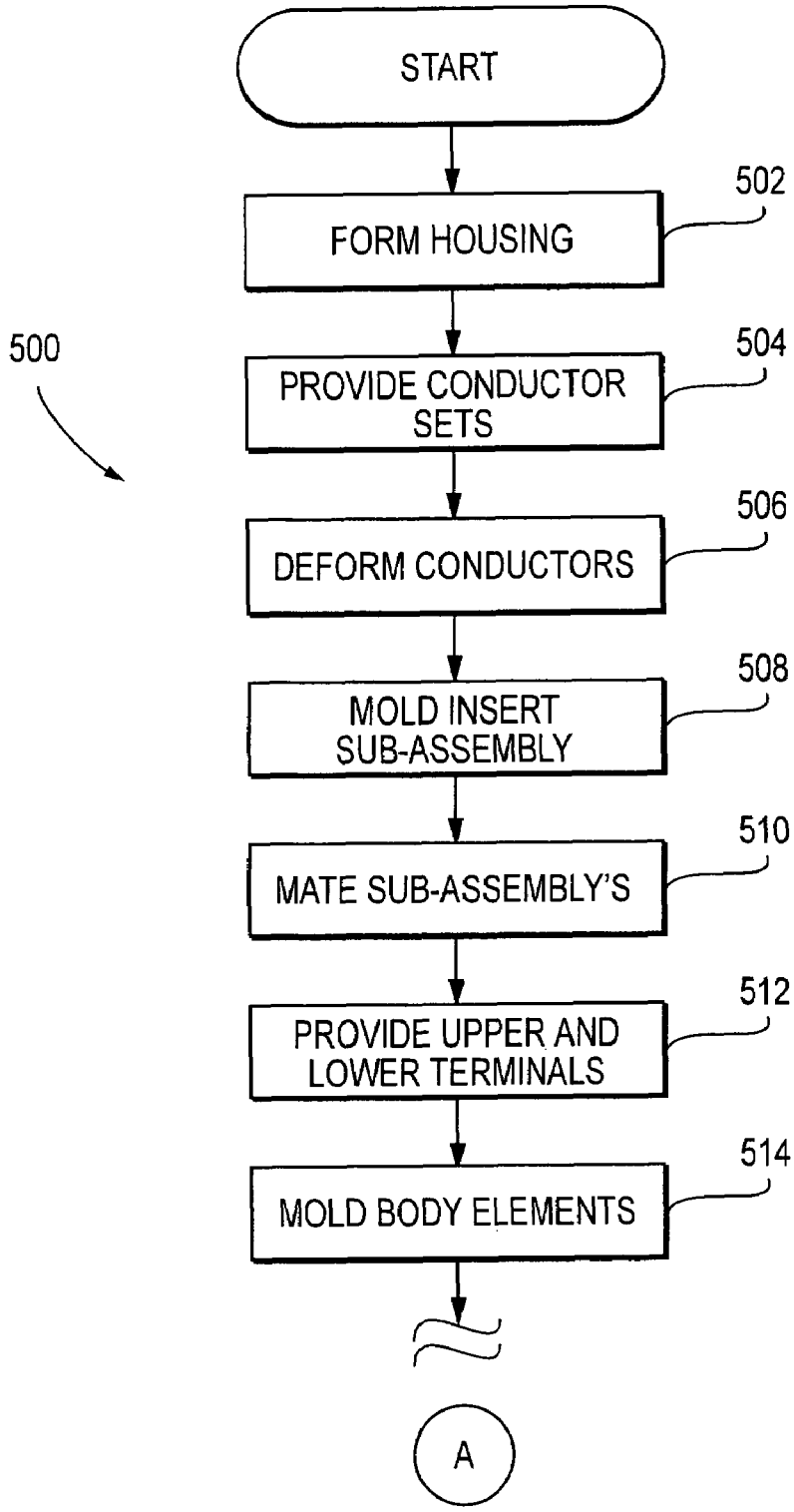
FIG. 5 is a logical flow diagram illustrating one exemplary embodiment of the method of manufacturing the connector assembly of the present invention.
Figure 5:
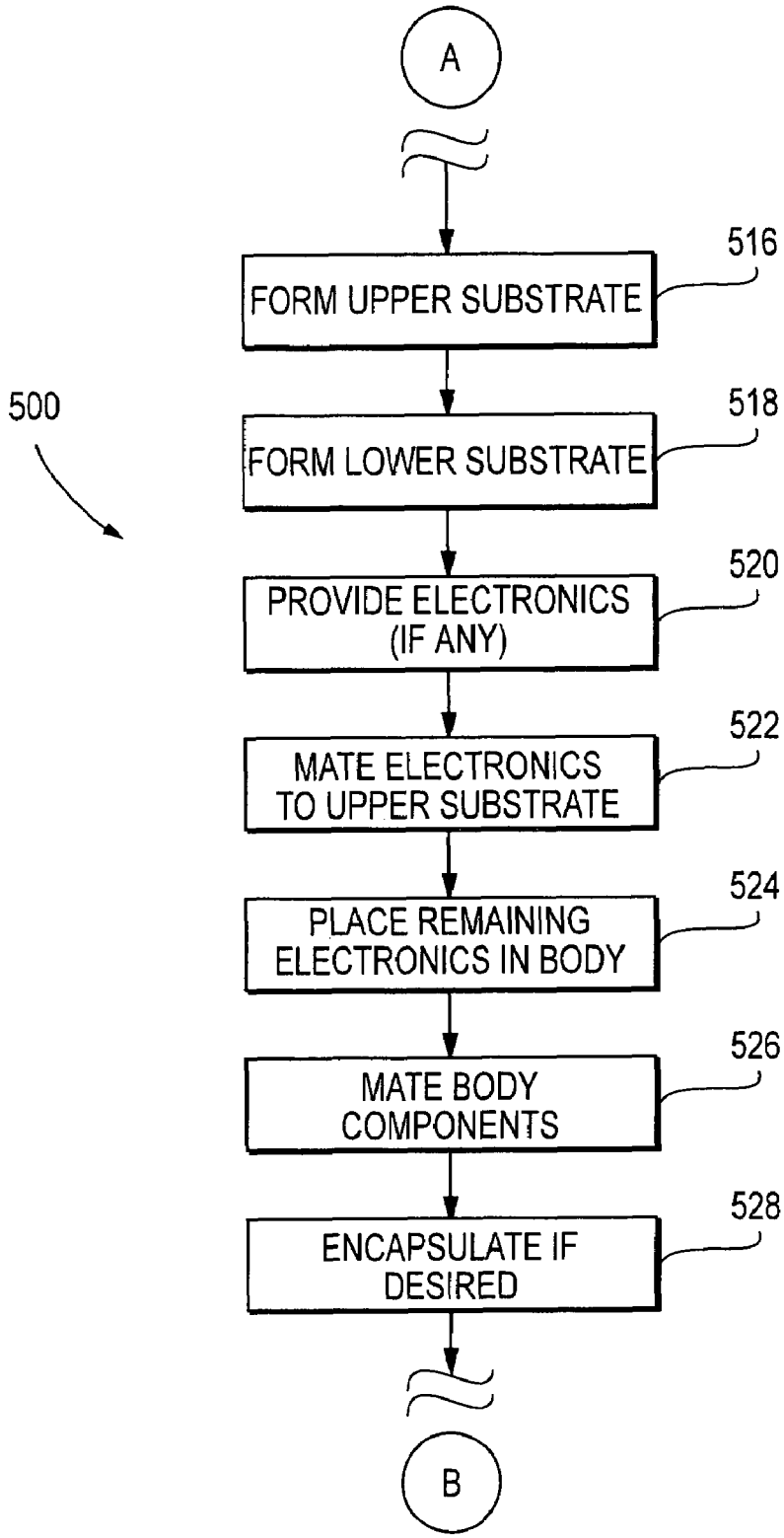
Figure 5:
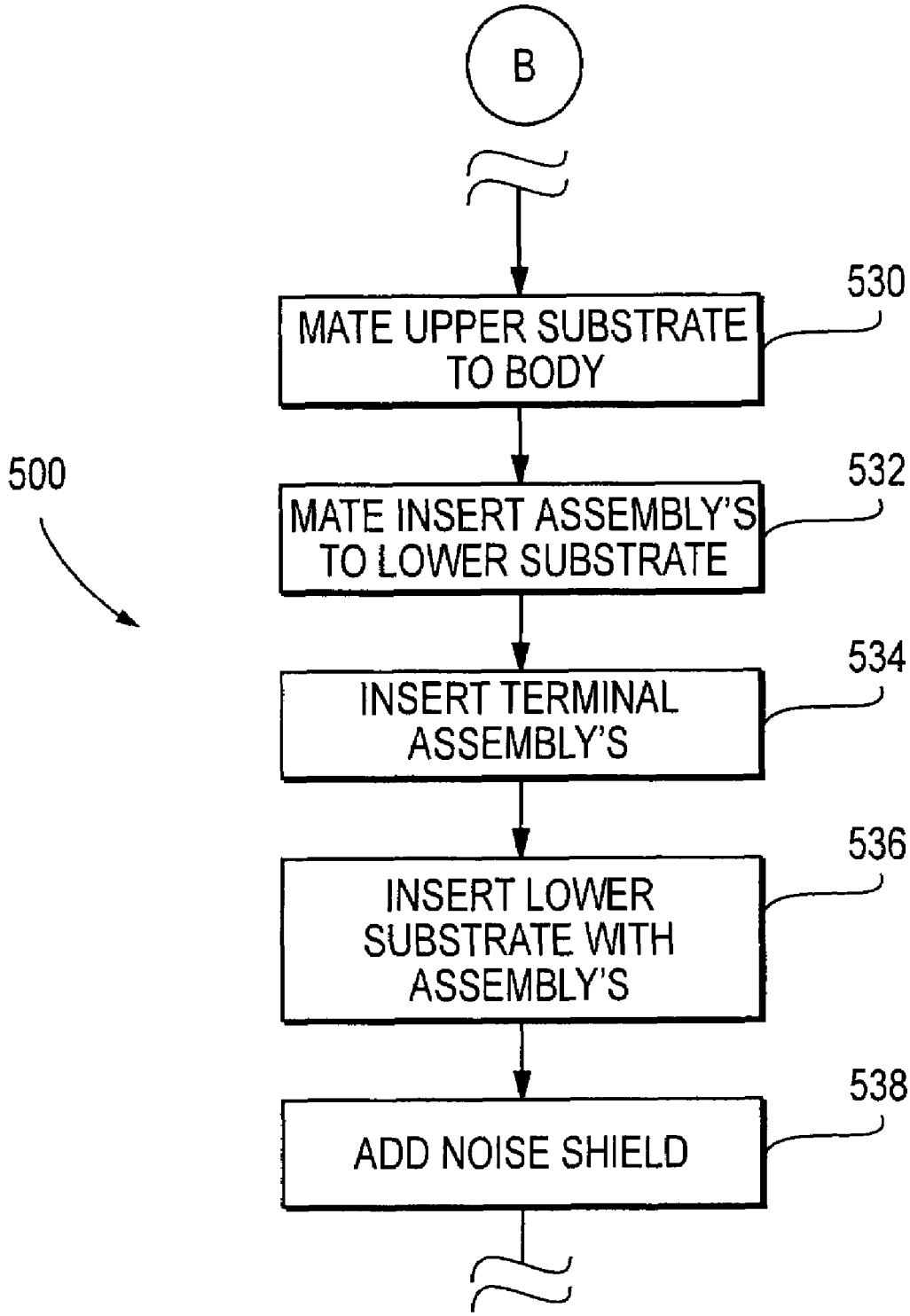

Referring now to FIG. 5, the method 500 of manufacturing the aforementioned connector assembly 100 is described in detail. It is noted that while the following description of the method 500 of FIG. 5 is cast in terms of the multiple port-pair connector assembly of FIG. 1, the broader method of the invention is equally applicable to other configurations (including e.g., the single-port embodiment of FIG. 2).

In the embodiment of FIG. 5, the method 500 generally comprises first forming the assembly housing element 102 in step 502. The housing is formed using an injection molding process of the type well known in the art, although other processes may be used. The injection molding process is chosen for its ability to accurately replicate small details of the mold, low cost, and ease of processing.

Next, two conductor sets (120*a*, 120*b*) are provided in step 504. As previously described, the conductor sets comprise metallic (e.g., copper or aluminum alloy) strips having a substantially square or rectangular cross-section and sized to fit within the slots of the connectors in the housing 102.

In step 506, the conductors are partitioned into sets; a first set 120*a* for use with a first connector recess of each port-pair (i.e., within the housing 102, and mating with the modular plug terminals), and a second set 120*b* for the other port in the port-pair. The conductors are formed to the desired shape(s) using a forming die or machine of the type well known in the art. Specifically, for the embodiment of FIG. 1, the first and second conductor sets 120*a*, 120*b* is deformed so as to produce the juxtaposed, substantially coplanar configuration as shown in FIG. 11 and previously described.

In step 508, the first and second conductor sets 120*a*, 120*b* are insert-molded within the respective portions of the terminal insert assembly 129, thereby forming the components shown in FIG. 11. In step 510, the two sub-components of the insert 129 are mated, such as via snap-fit, friction, adhesive, thermal bonding, etc.

In step 512, the upper and lower terminals 152, 154 are formed using similar methods to those used for the conductors 120*a*, 120*b*, although in the illustrated embodiment the upper and lower terminals 152, 154 need not be deformed (i.e., can remain straight) if desired.

Note also that either or both of the aforementioned conductor sets may also be notched (not shown) at their distal ends such that electrical leads associated with the electronic components (e.g. fine-gauge wire wrapped around the magnetic toroid element) may be wrapped around the distal end notch to provide a secure electrical connection.

In step 514, the first and second body elements 156, 158 of the (electronics) insert assembly 150 are formed, such as via injection or transfer molding. In one embodiment, a high-temperature polymer of the type ubiquitous in the art is used to form the body elements 156, 158, although this is not required, and other materials (even non-polymers) may be used.

Next, the upper substrate 140 is formed and perforated through its thickness with a number of apertures of predetermined size in step 516. Methods for forming substrates are well known in the electronic arts, and accordingly are not described further herein. Any conductive traces on the substrate required by the particular design are also added, such that necessary ones of the conductors, when received within the apertures, are in electrical communication with the traces.

The apertures within the primary substrate are arranged in two arrays of juxtaposed perforations, one at each end of the substrate, and with spacing (i.e., pitch) such that their position corresponds to the desired pattern, although other arrangements may be used. Any number of different methods of perforating the substrate may be used, including a rotating drill bit, punch, heated probe, or even laser energy. Alternatively, the apertures may be formed at the time of formation of the substrate itself, thereby obviating a separate manufacturing step.

Next, the lower substrate 170 is formed and is perforated through its thickness with a number of apertures of predetermined size in step 518. The apertures are arranged in an array of bi-planar perforations which receive corresponding ones of the lower conductors 154 therein, the apertures of the lower substrate acting to register and add mechanical stability to the lower set of conductors. Alternatively, the apertures may be formed at the time of formation of the substrate itself.

In step 520, one or more electronic components, such as the aforementioned toroidal coils and surface mount devices, are next formed and prepared (if used in the design). The manufacture and preparation of such electronic components is well known in the art, and accordingly is not described further herein.

The relevant electronic components are then mated to the upper substrate 140 in step 522. Note that if no components are used, the conductive traces formed on/within the primary substrate will form the conductive pathway between the first and second sets of conductors 120 and respective ones of the upper conductors 152. The components may optionally be (i) received within corresponding apertures designed to receive portions of the component (e.g., for mechanical stability), (ii) bonded to the substrate such as through the use of an adhesive or encapsulant, (iii) mounted in "free space" (i.e., held in place through tension generated on the electrical leads of the component when the latter are terminated to the substrate conductive traces and/or conductor distal ends, or (iv) maintained in position by other means. In one embodiment, the surface mount components are first positioned on the primary substrate, and the magnetics (e.g., toroids) positioned thereafter, although other sequences may be used. The components are electrically coupled to the PCB using a eutectic solder re-flow process as is well known in the art.

In step 524, the remaining electrical components are disposed within the cavity of the insert assembly 150 and wired electrically to the appropriate ones of the upper and lower terminals 152, 154. This wiring may comprise wrapping, soldering, welding, or any other suitable process to form the desired electrical connections.

In step 526, the two completed body elements 156, 158 are mated (e.g., snap-fit, bonded, etc.) so as to form the body 151 of the insert assembly 150. The electronic components of the assembly 150 are then optionally secured with silicone or other encapsulant (step 528), although other materials may be used. This completes the insert assembly sub-structure 153.

In step 530, the assembled upper substrate with SMT/magnetics is then mated with the insert assembly sub-structure 153 and its components, specifically such that the upper terminals 152 are disposed in their corresponding apertures of the substrate 140. The terminals 152 are then bonded to the substrate contacts such as via soldering or welding to ensure a rigid electrical connection for each. The completed insert assembly may be electrically tested to ensure proper operation if desired.

In step 532, two of the completed insert assemblies 150 are mated to a common lower substrate 170 and bonded thereto if desired to as to form a substantially rigid insert structure.

In step 534, the terminal insert assemblies 129 previously formed are inserted within their grooves formed in the cavities 134 of the housing 102, and snapped into place.

Next, the completed insert structures of step 532 are inserted into the housing and snapped into place, thereby completing the (unshielded) connector assembly 100 (step 536).

Alternatively, in step 534, the terminal insert assemblies 129 can be mated directly to the upper substrate; e.g., by inserting the appropriate end of the upper substrate 140 between the conductor ends 120*a*, 120*b* and bonding the latter to their corresponding conductive pads/traces on the surface of the substrate 140, such as via a soldering or welding process. The assembled components (i.e. insert assemblies 150 with attached lower substrate 170 and terminal insert assembly 129) can then be inserted as a unit into the housing per step 536.

Lastly, in step 538, the external noise shield (if used) is fitted onto the assembled connector 100, and the various ground straps and clips as previously described positioned so as to provide grounding of the noise shield.

With respect to the other embodiments described herein (i.e., single connector housing, connector assembly with LEDs or light pipes, etc.), the foregoing method may be modified as necessary to accommodate the additional components. Such modifications and alterations will be readily apparent to those of ordinary skill, given the disclosure provided herein.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A connector assembly comprising:

a connector housing comprising a plurality of recesses each adapted to receive at least a portion of a modular plug, said modular plug having a plurality of first terminals disposed thereon;

a plurality of sets of conductors disposed at least partly within respective ones of said recesses and adapted to interface electrically with respective ones of said first terminals of said plug; and an application-specific insert structure comprising at least one substrate having a plurality of electrically conductive pathways associated therewith, and a plurality of electronic components disposed substantially thereon;

wherein said pathways of said at least one substrate interface with respective ones of said conductors to form an electrical pathway from said first terminals through said conductors and at least one of said electronic components; and wherein said assembly is adapted to receive either of two variants of said application-specific insert structure without altering the footprint of said assembly.

2. The connector assembly of claim 1, wherein said at least one substrate is disposed substantially atop an insert body in a substantially horizontal orientation, and said insert body and said substrate are removable as a single unit from said housing.

3. The connector assembly of claim 1, further comprising at least an external noise shield, and at least one internal noise shield, said internal noise shield being configured to mitigate noise between respective ones of signal pathways within said connector assembly.

4. The connector assembly of claim 1, wherein said housing is adapted to accommodate a plurality of different configurations of said insert structure either simultaneously or alternatively.

5. The connector assembly of claim 4, wherein said plurality of different configurations comprise at least: (i) a gigabit Ethernet (GBE) configuration, and (ii) an Ethernet 10/100 Mbps configuration.

6. The connector assembly of claim 1, further comprising at least one indicator assembly adapted to provide one or more indications visible from a front face of said housing.

7. The connector assembly of claim 6, wherein said at least one indicator assembly comprises a plurality of light pipes, said indicator assembly being mounted substantially along a rear face of said housing.

8. The connector assembly of claim 4, wherein said substrate is adapted to accommodate a plurality of different configurations of said insert body.

9. The connector assembly of claim 8, wherein said adaptation of said substrate comprises a plurality of apertures adapted to receive second terminals associated with any of said plurality of different configurations of said insert body, said different configurations each comprising a different pin-out configuration for third terminals of said insert body.

10. A connector assembly adapted to provide application-specific conditioning of at least some signals passing therethrough, the assembly comprising:

a connector housing comprising a recess adapted to receive at least a portion of a modular plug, said modular plug having a plurality of first terminals disposed thereon;

a set of conductors disposed at least partly within said recess and adapted to interface electrically with respective ones of said first terminals of said plug; and an application-specific insert structure comprising at least one substrate having a plurality of electrically conductive pathways and electronic components associated therewith, and at least one electronic component disposed substantially thereon, said at least one component performing at least a portion of said signal conditioning;

wherein said pathways of said at least one substrate interface with respective ones of said conductors to form an electrical pathway from said first terminals through said conductors and at least one of said at least one electronic component; and wherein said assembly is adapted to receive alternatively any of at least two variants of said application-specific insert structure without altering the footprint of said assembly relative to a connector assembly without said application-specific signal conditioning.

11. The connector assembly of claim 10, further comprising a plurality of LED indicators.

12. The connector assembly of claim 11, further comprising an external noise shield adapted to cover a majority of the external surface area of said assembly.

13. The connector assembly of claim 12, wherein said signal conditioning comprises signal filtering for noise or other unwanted signal components.

14. The connector assembly of claim 10, further comprising an external noise shield adapted to cover a majority of the external surface area of said assembly.

15. The connector assembly of claim 14, wherein said signal conditioning comprises signal filtering for noise or other unwanted signal components.

16. The connector assembly of claim 15, further comprising a plurality of LED indicators.

17. The connector assembly of claim 10, wherein said application-specific insert structure comprises a polymer insert body adapted to at least partly support said substrate.

18. The connector assembly of claim 17, wherein said at least one substrate is disposed substantially atop said insert body in a substantially horizontal orientation, and said insert body, said at least one electronic component, and said substrate are removable as a single unit from said housing.

19. The connector assembly of claim 17, wherein said at least partly supporting of said substrate comprises said substrate being disposed substantially atop said insert body.

20. The connector assembly of claim 19, wherein said at least one electronic component comprises a plurality of components, some of said plurality being disposed on a first side of said substrate, and some of said plurality being disposed on a second side of said substrate.

21. The connector assembly of claim 20, further comprising a plurality of external interface conductors, said external interface conductors being received at least partly within said insert body and penetrating through apertures formed in said substrate and electrically interfacing with at least one of said plurality of components.

22. The connector assembly of claim 21, wherein said at least two variants comprise at least: (i) a gigabit Ethernet (GBE) configuration, and (ii) an Ethernet 10/100 Mbps configuration.

23. An application-specific RJ-type connector assembly adapted for placement on a parent substrate, comprising:

a connector housing comprising a recess adapted to receive at least a portion of an RJ-type modular plug, said modular plug having a plurality of first terminals disposed thereon;

a set of conductors disposed at least partly within said recess and adapted to interface electrically with respective ones of said first terminals of said plug; and an insert assembly adapted to be received at least partly within said housing, said insert assembly comprising one of at least two different application-specific interchangeable signal conditioning circuits that may be received within said housing and which is configured so that, when said insert with any one of said at least two circuits is disposed at least partly in said housing, said connector assembly is footprint interchangeable with a non-conditioned RJ-type connector assembly.

24. The assembly of claim 23, wherein said insert assembly comprises:

a substrate disposed in a substantially horizontal orientation within said housing and atop an insert body; and a plurality of electronic components disposed proximate said substrate, said components forming said one signal conditioning circuit.

25. A method of re-configuring a connector assembly having a housing adapted to receive a plurality of different configurations of electrical signal conditioning sub-assemblies, the method comprising:

providing a first configuration of signal conditioning sub-assembly within said housing, said first configuration being adapted for a first application;

identifying a second application not served by said first configuration;

providing a second configuration of signal conditioning subassembly adapted for said second application;

removing said first configuration sub-assembly from said housing; and inserting said second configuration sub-assembly into said housing;

wherein said first and second configurations of said signal conditioning sub-assembly each comprise:

an insert body;

a substrate disposed atop said insert body;

a plurality of electronic components disposed substantially upon said substrate; and at least first and second terminal sets adapted for mating with said substrate and an external device, respectively; and wherein said acts of removing and inserting comprise, removing and inserting, respectively, said sub-assemblies in their entirety.

26. The assembly of claim 25, wherein said electronic components comprise a plurality of toroidal coils.

27. The assembly of claim 26, wherein said substrate is disposed in a substantially horizontal orientation within said housing when one of said sub-assemblies is inserted into said housing.

28. The method of claim 27, wherein said at least first and second terminal sets adapted for mating with said substrate and an external device, respectively comprise terminal sets that each penetrate said substrate through apertures formed therein.

29. An application-specific RJ-type connector assembly adapted for conditioning of at least some signals that pass therethrough, and for placement on a parent substrate, comprising:

a connector housing comprising a recess adapted to receive at least a portion of an RJ-type modular plug, said modular plug having a plurality of first terminals disposed thereon;

a set of conductors disposed at least partly within said recess and adapted to interface electrically with respective ones of said first terminals of said plug; and an insert assembly comprising a first of at least two different application-specific interchangeable signal conditioning circuits disposed on a substrate of said insert assembly;

wherein said connector assembly is footprint interchangeable with both:

(i) an RJ-type connector assembly having an insert assembly using another of said at least two different signal conditioning circuits; and (ii) a non-conditioned RJ-type connector assembly.

30. The assembly of claim 29, wherein said insert assembly comprises:

a substrate disposed in a substantially horizontal orientation within said housing and atop an insert body; and a plurality of electronic components disposed proximate said substrate, said components forming said first signal conditioning circuit.

31. A connector assembly adapted to provide application-specific conditioning of at least some signals passing therethrough, the assembly comprising:

a connector housing comprising a recess adapted to receive at least a portion of an RJ-type modular plug, said modular plug having a plurality of first terminals disposed thereon;

a set of conductors disposed at least partly within said recess and adapted to interface electrically with respective ones of said first terminals of said plug; and an application-specific insert structure comprising at least one substantially horizontal substrate having a plurality of electrically conductive pathways and electronic components associated therewith, said at least one component performing at least a portion of said signal conditioning, said insert structure further comprising a molded polymer insert element upon which said substrate is directly or indirectly disposed;

wherein said insert structure is received by a cavity of said housing via a rear opening thereof;

wherein said pathways of said at least one substrate interface with respective ones of said conductors to form an electrical pathway from said first terminals through said conductors and at least one of said at least one electronic component; and wherein said assembly is adapted to receive alternatively any of at least two variants of said application-specific insert structure without altering the footprint of said assembly, said at least two variants each having electrical circuitry which is at least partly different than others of said variants.

32. The assembly of claim 31, wherein said assembly is further adapted to receive alternatively any of said at least two variants of said application-specific insert structure, each of said variants having a different pin-out pattern for a plurality of second conductors of said insert structure, said second conductors being used for mating to a parent device or substrate.

33. The assembly of claim 31, wherein said plug comprises an RJ-45 type connector plug, and said at least two variants of said circuitry are each compliant with an industry standard specifying signal conditioning requirements.

34. The assembly of claim 33, wherein said connector assembly is adapted to that said insert structure is removable from said housing after assembling said connector assembly.

* * * * *